US007768476B2

(12) United States Patent
Han

(10) Patent No.: US 7,768,476 B2
(45) Date of Patent: Aug. 3, 2010

(54) PLASMA DISPLAY APPARATUS AND DRIVING METHOD THEREOF

(75) Inventor: Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 963 days.

(21) Appl. No.: 11/349,247

(22) Filed: Feb. 8, 2006

(65) Prior Publication Data

US 2006/0227071 A1 Oct. 12, 2006

(30) Foreign Application Priority Data

Apr. 6, 2005 (KR) ..... 10-2005-0028735

(51) Int. Cl.
*G09G 3/36* (2006.01)

(52) U.S. Cl. ..... 345/60

(58) Field of Classification Search ..... 345/60–72
See application file for complete search history.

(56) References Cited

U.S. PATENT DOCUMENTS

| | | | | |
|---|---|---|---|---|
| 5,945,984 | A | 8/1999 | Kuwashiro | 345/206 |
| 6,150,767 | A * | 11/2000 | Huang | 315/169.4 |
| 6,154,187 | A * | 11/2000 | Kim | 345/60 |
| 6,275,204 | B1 * | 8/2001 | Kim | 345/72 |
| 6,603,446 | B1 * | 8/2003 | Kanazawa et al. | 345/60 |
| 7,450,089 | B2 * | 11/2008 | Son | 345/60 |
| 2002/0070906 | A1 * | 6/2002 | Kawasaki et al. | 345/60 |
| 2002/0175631 | A1 * | 11/2002 | Kim | 315/169.1 |
| 2003/0080953 | A1 * | 5/2003 | Ting | 345/206 |
| 2003/0085853 | A1 * | 5/2003 | Shiiki et al. | 345/60 |
| 2005/0057449 | A1 | 3/2005 | Son | 345/60 |
| 2006/0033681 | A1 * | 2/2006 | Hashimoto et al. | 345/60 |

FOREIGN PATENT DOCUMENTS

| | | |
|---|---|---|
| CN | 1601593 | 3/2005 |
| EP | 1 353 319 A1 | 10/2003 |
| EP | 1 662 470 | 5/2006 |
| TW | 502273 | 9/2002 |
| WO | WO 2005/022503 | 3/2005 |

OTHER PUBLICATIONS

Chinese Office Action dated Mar. 7, 2007 (and English-language translation).
European Office Action dated Jan. 9, 2008.
Taiwanese Office Action dated Sep. 16, 2009 with English translation.

* cited by examiner

*Primary Examiner*—Alexander Eisen
*Assistant Examiner*—Nelson Lam
(74) *Attorney, Agent, or Firm*—KED & Associates, LLP

(57) ABSTRACT

Embodiments of the present invention relate to a plasma display apparatus in which an arrangement of use channels of data drive ICs is improved. The plasma display apparatus may include a plasma display panel including first and second address electrode groups that correspond to first and second screen regions, respectively, and that match each other. First data drive ICs may include channels connected to the first address electrode group. Second data drive ICs may include channels connected to the second address electrode group. An nth channel of the first data drive ICs from one side of the first screen region may be a dummy channel, an nth channel from the other side of the first screen region may be a dummy channel, and an nth channel of the second data drive ICs from one side of the second screen region, which matches the one side of the first screen region, may also be a dummy channel.

30 Claims, 21 Drawing Sheets

PLASMA DISPLAY APPARATUS AND DRIVING METHOD THEREOF

This nonprovisional application claims priority under 35 U.S.C. §119(a) from Patent Application No. 10-2005-0028735 filed in Korea on Apr. 6, 2005 the entire contents of which are hereby incorporated by reference.

BACKGROUND OF THE INVENTION

1. Field of the Invention

Embodiments of the present invention relate to a plasma display apparatus that includes an arrangement of channels of data drive integrated circuits. Embodiments of the present invention may match data signals to respective regions when a total number of address electrodes on a plasma display panel that is driven in the state of being divided into two regions is different from a number of channels included in all data drive integrated circuits.

2. Background of Related Art

In a plasma display panel, a barrier rib formed between a front panel and a rear panel may form one unit cell. Each cell may be filled with a main discharge gas, such as neon (Ne), helium (He) or a mixed gas (Ne+He) of Ne and He, and an inert gas containing a small amount of xenon. When a discharge is generated using a high frequency voltage, the inert gas may generate vacuum ultraviolet rays and excite phosphors formed between the barrier ribs, thus displaying an image. Such plasma display panels may be thin and lightweight and, thus, are attracting attention as next-generation display devices.

SUMMARY OF THE INVENTION

Embodiments of the present invention may provide a plasma display apparatus and driving method thereof, wherein data signals can be effectively matched on an address-electrode-line basis without a complicated data processing process by improving the arrangement of use channels and non-use channels (or dummy channels) of data drive ICs.

In accordance with an embodiment of the present invention, a plasma display apparatus may be provided that includes a plasma display panel including first and second address electrode groups that correspond to first and second screen regions, respectively, and that match each other. First data drive ICs including channels connected to the first address electrode group are provided and second data drive ICs including channels connected to the second address electrode group are also provided. An nth channel of a first data drive IC from a first side of the first screen region is a dummy channel, an nth channel from a second side of the first screen region is the dummy channel, and an nth channel of a second data drive IC from a first side of the second screen region, which matches the first side of the first screen region, is also a dummy channel.

In accordance with an example embodiment of the present invention, a method is provided of driving a plasma display apparatus. This may include applying data to first data drive ICs and rearranging the data so that second region data that are applied from second data drive ICs to a second address electrode group match first region data that are applied from the first data drive ICs to a first address electrode group. The rearranged data may be applied to the second data drive ICs.

When a total number of address electrodes on a plasma display panel that is driven in the state of being divided into two regions is different from the number of channels included in all data drive ICs, data signals applied to the respective regions can be matched by improving the arrangement of use channels of the data drive ICs.

Other objects, advantages and salient features will become apparent from the following detailed description taken in conjunction with the annexed drawings, which disclose preferred embodiments of the invention.

BRIEF DESCRIPTION OF THE DRAWINGS

Arrangements and embodiments of the present invention will be described in detail with reference to the following drawings, in which like numerals refer to like elements and wherein.

DETAILED DESCRIPTION OF PREFERRED EMBODIMENTS

Arrangements and preferred embodiments of the present invention are described below in more detail with reference to the drawings.

Figure 1:
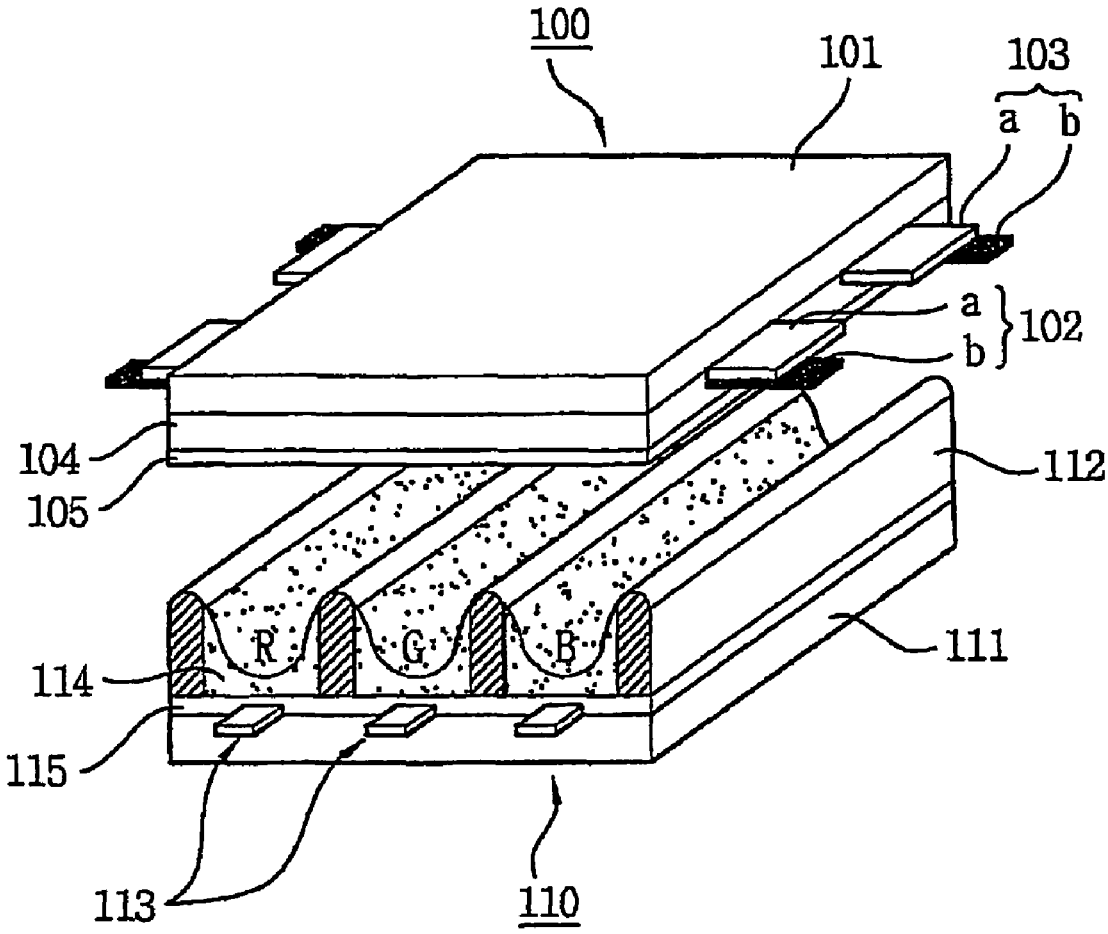
FIG. 1 is a perspective diagram showing a plasma display panel according to an example arrangement.

FIG. 1 is a perspective diagram showing a plasma display panel according to an example arrangement. Other arrangements are also possible.

As shown in FIG. 1, the plasma display panel includes a front panel 100 in which a plurality of sustain electrode pairs each composed of a scan electrode 102 and a sustain electrode 103 is arranged on a front substrate 101 serving as a display surface on which images are displayed. The plasma display panel also includes a rear panel 110 in which a plurality of address electrodes 113 arranged to cross the plurality of sustain electrode pairs is arranged on a rear substrate 111 serving as a rear surface. The front panel 100 and the rear panel 110 are parallel to each other at a predetermined interval.

The front panel 100 includes pairs of scan electrodes 102 and sustain electrodes 103 that are used to produce a mutual discharge in each discharge cell and maintain the light emission of the discharge cell. That is, each of the scan electrodes 102 and each of the sustain electrodes 103 include a transparent electrode "a" made of a transparent ITO material and a bus electrode "b" made of a metallic material. The scan electrodes 102 and the sustain electrodes 103 are covered with at least one upper dielectric layer 104 that limits a discharge current and insulates the electrode pairs. A protection layer 105 on which magnesium oxide (MgO) is deposited to easily produce discharge conditions is formed on the entire surface of the upper dielectric layer 104.

Stripe type (or a well type) barrier ribs 112 for forming a plurality of discharge spaces (i.e., discharge cells) are arranged in parallel on the rear panel 110. Furthermore, address electrodes 113 that perform address discharges to generate vacuum ultraviolet rays are arranged parallel to the barrier ribs 112. R, G and B phosphors 114 that emit visible rays for image display upon address discharges are coated on the top surface of the rear panel 110. A lower dielectric layer 115 for protecting the address electrodes 113 is formed between the address electrodes 113 and the phosphors 114.

In such a plasma display panel, a plurality of discharge cells are formed in matrix form. The discharge cells are formed at points where the scan electrodes or the sustain electrodes cross the address electrodes. An electrode arrangement for forming a plurality of discharge cells in matrix form is described below with reference to FIG. 2.

Figure 2:
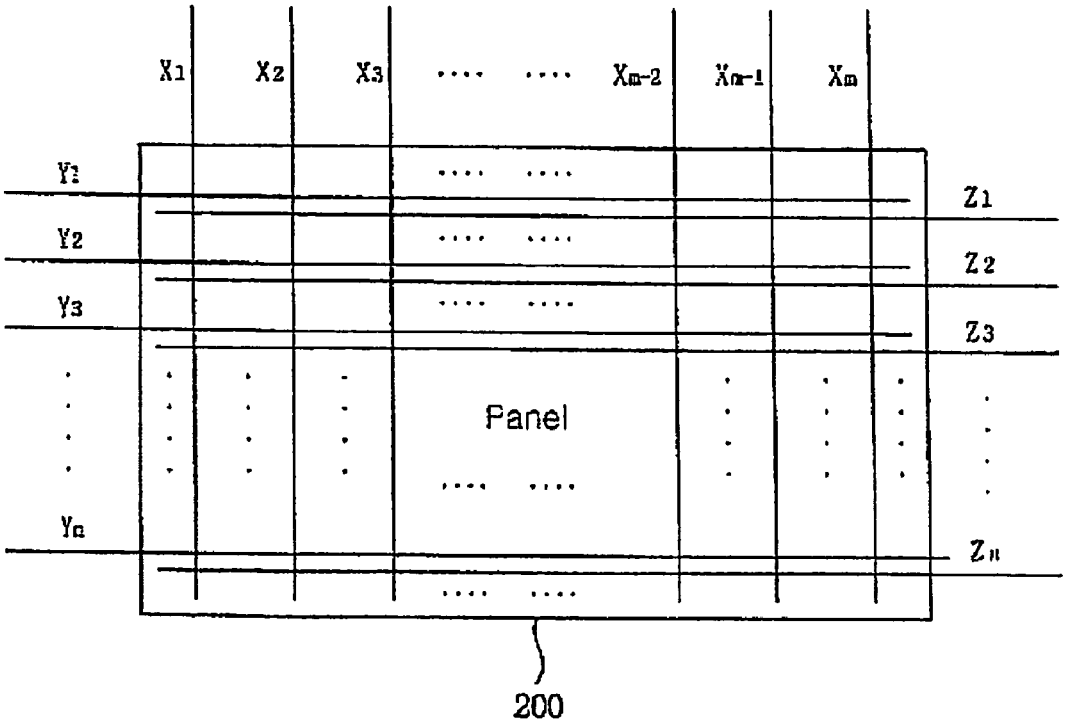
FIG. 2 is a diagram illustrating an arrangement of electrodes in the plasma display panel according to an example arrangement.

FIG. 2 is a diagram illustrating an arrangement of electrodes in a plasma display panel 200 according to an example arrangement. Other arrangements are also possible.

As illustrated in FIG. 2, a plurality of scan electrodes Y1 to Yn and a plurality of sustain electrodes Z1 to Zn are arranged parallel to each other in the plasma display panel 200. A plurality of address electrodes X1 to Xm are arranged to cross the scan electrodes Y1 to Yn and the sustain electrodes Z1 to Zn.

Drive circuits are provided for applying predetermined drive signals to the electrodes of the plasma display panel 200. The drive circuits apply the drive signals to the electrodes of the plasma display panel 200, thus implementing an image. The structure in which the drive circuits are connected to the plasma display panel 200 may be referred to as a "plasma display apparatus."

As the size of the plasma display panels increases, an address period may become excessively long and a sustain period may decrease all discharge cells are addressed using a single data drive unit. As a result, brightness implemented when the plasma display panel is driven may decrease because a total number of sustain pulses decreases.

A dual scan method may be used in which one plasma display panel is divided into two regions and the two regions are respectively addressed so as to prevent the address period from increasing excessively. An example of this method will be described with reference to FIG. 3.

Figure 3:
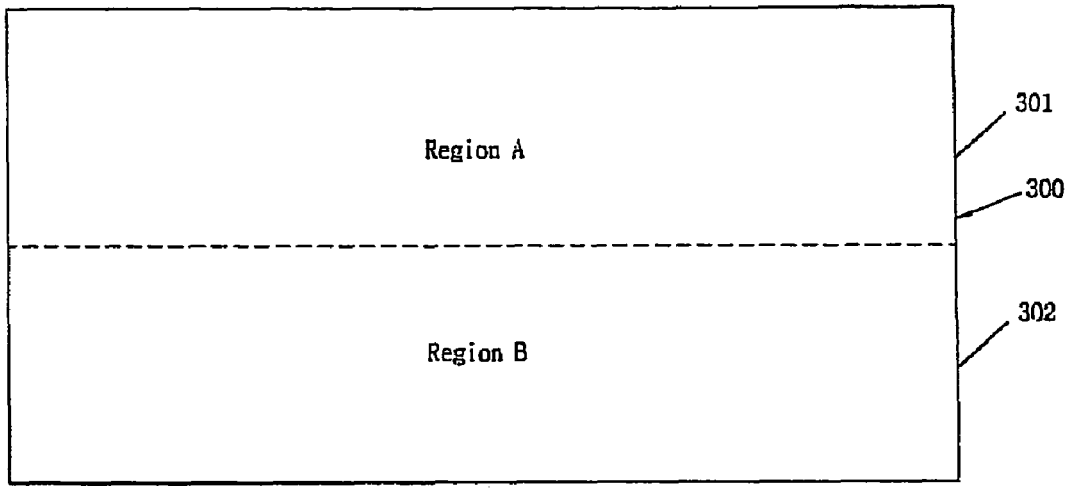
FIG. 3 is a diagram illustrating a dual scan method according to an example arrangement.

FIG. 3 is a diagram illustrating a dual scan method according to an example arrangement. Other arrangements are also possible. As illustrated in FIG. 3, in the dual scan method, one plasma display panel 300 is divided into two regions (i.e., a region A 301 and a region B 302). Addressing operations are simultaneously performed in the regions 301 and 302. For example, in FIG. 3, the plasma display panel 300 includes a drive unit (not shown) for addressing the discharge cells of the region A 301 and another drive unit (not shown) for addressing the discharge cells of the region B 302. The drive units may simultaneously address the discharge cells of the region A 301 and the region B 302.

Figure 4:
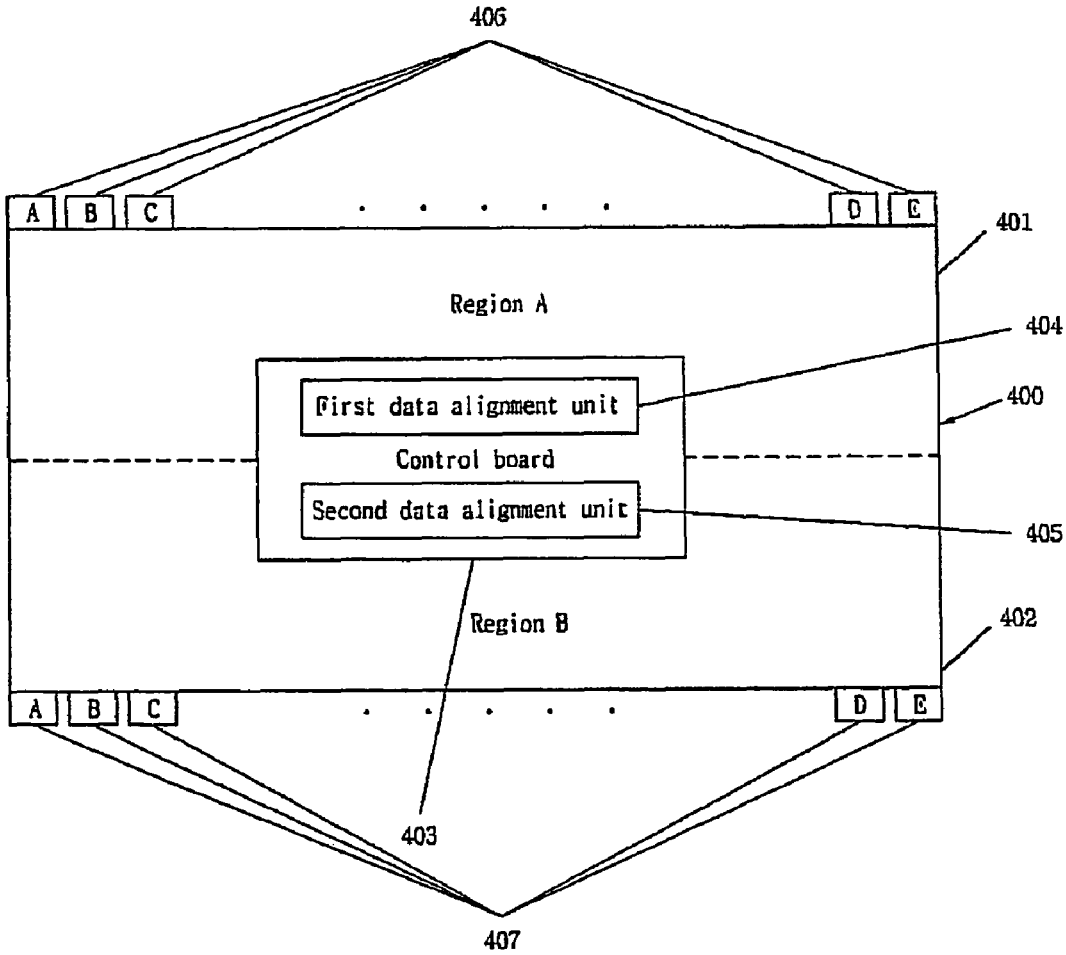
FIG. 4 is a diagram illustrating a connection structure of drive units in a dual scan method according to an example arrangement.

A connection structure of drive units in a dual scan method will be described with reference to FIG. 4. More specifically, FIG. 4 is a diagram illustrating a connection structure of drive units in a dual scan method according to an example arrangement. Other arrangements are also possible.

As shown in FIG. 4, in the case where one plasma display panel 400 is divided into two regions (i.e., a region A 401 and a region B 402), a control board 403 may include a first data alignment unit 404 for supplying aligned data to the region A 401 and a second data alignment unit 405 for supplying aligned data to the region B 402.

Furthermore, a plurality of data drive integrated circuits (ICs) 406 for driving the address electrodes of the region A 401 and a plurality of data drive ICs 407 for driving the address electrodes of the region B 402 are connected to the plasma display panel 400.

In the structure, when data aligned by the first data alignment unit 404 are supplied to the data drive ICs 406, the data drive ICs 406 apply the aligned data to the address electrodes of the region A 401. Furthermore, data aligned by the second data alignment unit 405 are supplied to the address electrodes of the region B 402 through the data drive ICs 407. That is, one address electrode may be divided into two regions and the divided electrodes of the two regions may be respectively driven by different data drive ICs. An example of images implemented in the plasma display apparatus will be described with reference to FIG. 5.

Figure 5:
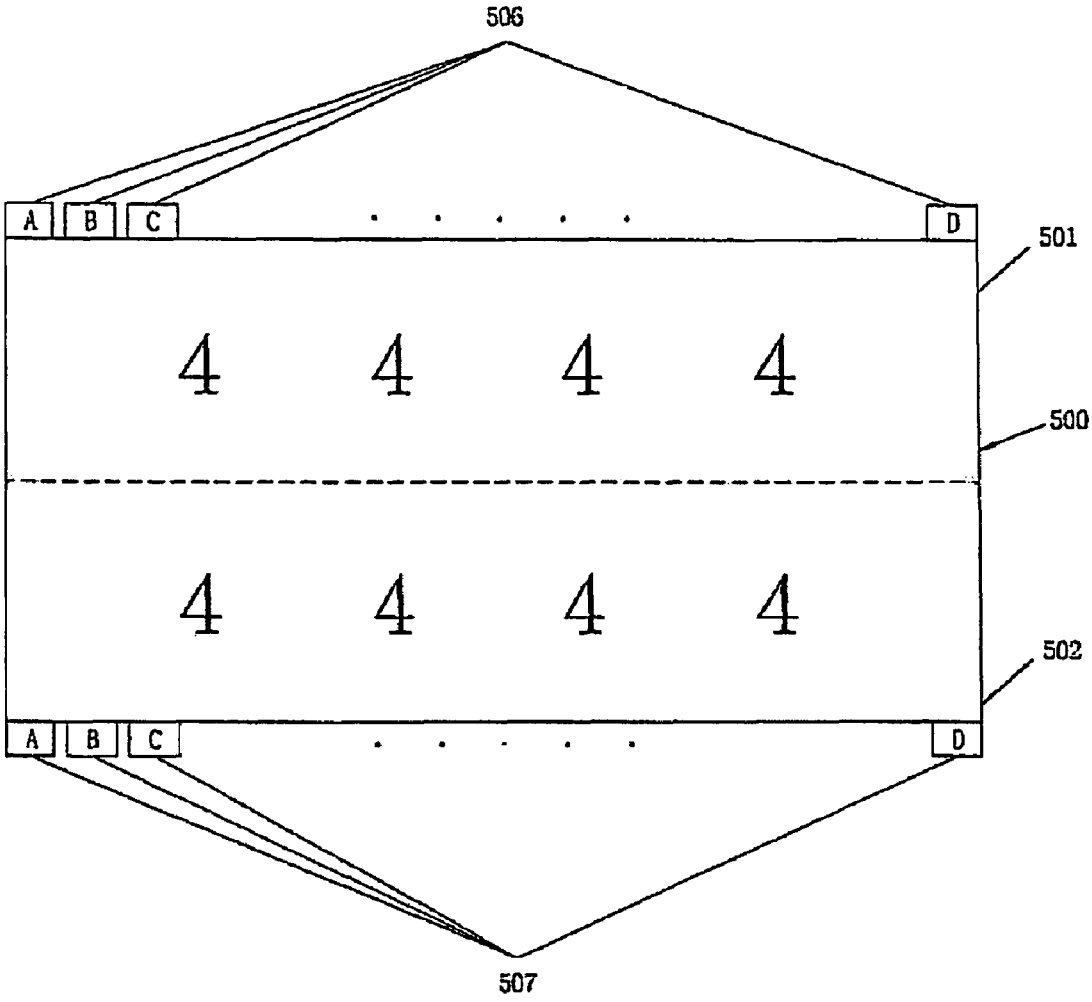
FIG. 5 is a diagram illustrating images implemented in the plasma display apparatus according to an example arrangement.

FIG. 5 is a diagram illustrating images implemented in a plasma display apparatus according to an example arrangement. Other images and arrangements are also possible.

As shown in FIG. 5, images may be displayed on two regions 501 and 502 of a plasma display panel 500. If it is necessary for the images of the region 501 and the region 502 to match each other, data signals supplied from data drive ICs 506 and data drive ICs 507 match each other. For example, data signals that are applied from the data drive IC A of the data drive ICs 506 to the address electrodes of the region 501, and data signals that are applied from the data drive IC A of the data drive ICs 507 to the address electrodes of the region 502 must match each other. In other words, for an address electrode $X_1$ on the plasma display panel 500, the data drive IC A of the data drive ICs 506 applies the data signal to the address electrode $X_1$ in the region 501, and the data drive IC A of the data drive ICs 507 applies the data signal to the address electrode $X_1$ in the region 502. Thus, the data signals applied to the address electrodes $X_1$ (i.e., the data signal supplied by the data drive IC A of the data drive IC 506 and the data signal supplied by the data drive IC A of the data drive ICs 507) must match each other.

Figure 6:
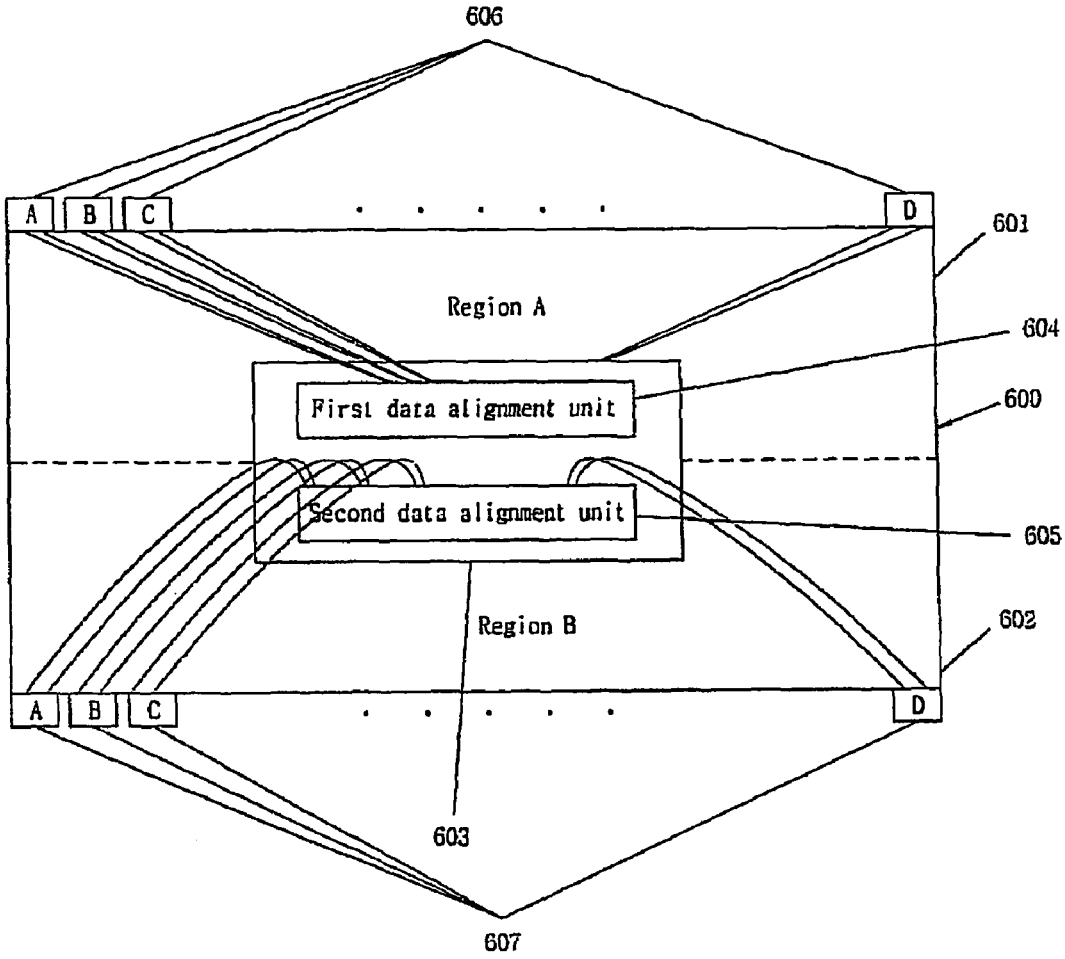
FIG. 6 is a diagram illustrating a method of matching data signals that are supplied to two regions of a plasma display panel according to an example arrangement.

An example of a method of matching data signals will be described below with reference to FIG. 6. More specifically, FIG. 6 is a diagram illustrating a method of matching data signals that are supplied to two regions of the plasma display according to an example arrangement. Other arrangements are also possible.

Referring to FIG. 6, supply directions of data signals, which are applied to address electrodes in a region B 602, from a second data alignment unit 605 for arranging the data signals to be supplied to the region B 602 of a plasma display panel 600 are the same as supply directions of signals applied from a first data alignment unit 604. One reason why the supply directions of the first data alignment unit 604 and the second data alignment unit 605 are the same is that the first data alignment unit 604 and the second data alignment unit 605 have substantially a same structure. As a result, data pulses (or signals or waveforms) supplied from the second data alignment unit 605 to the region B 602 have supply paths longer than those of data pulses (or signals or waveforms) supplied from the first data alignment unit 604 to the region A 601. Further, conducting wires, through which the data pulses supplied from the second data alignment unit 605 to the region B 602, may have a curved shape as compared to a linear shape. Accordingly, the data pulses supplied from the second data alignment unit 605 to the region B 602 may have more noise than data signals supplied from the first data alignment unit 604 and may also have voltage drop problems.

Figure 7:
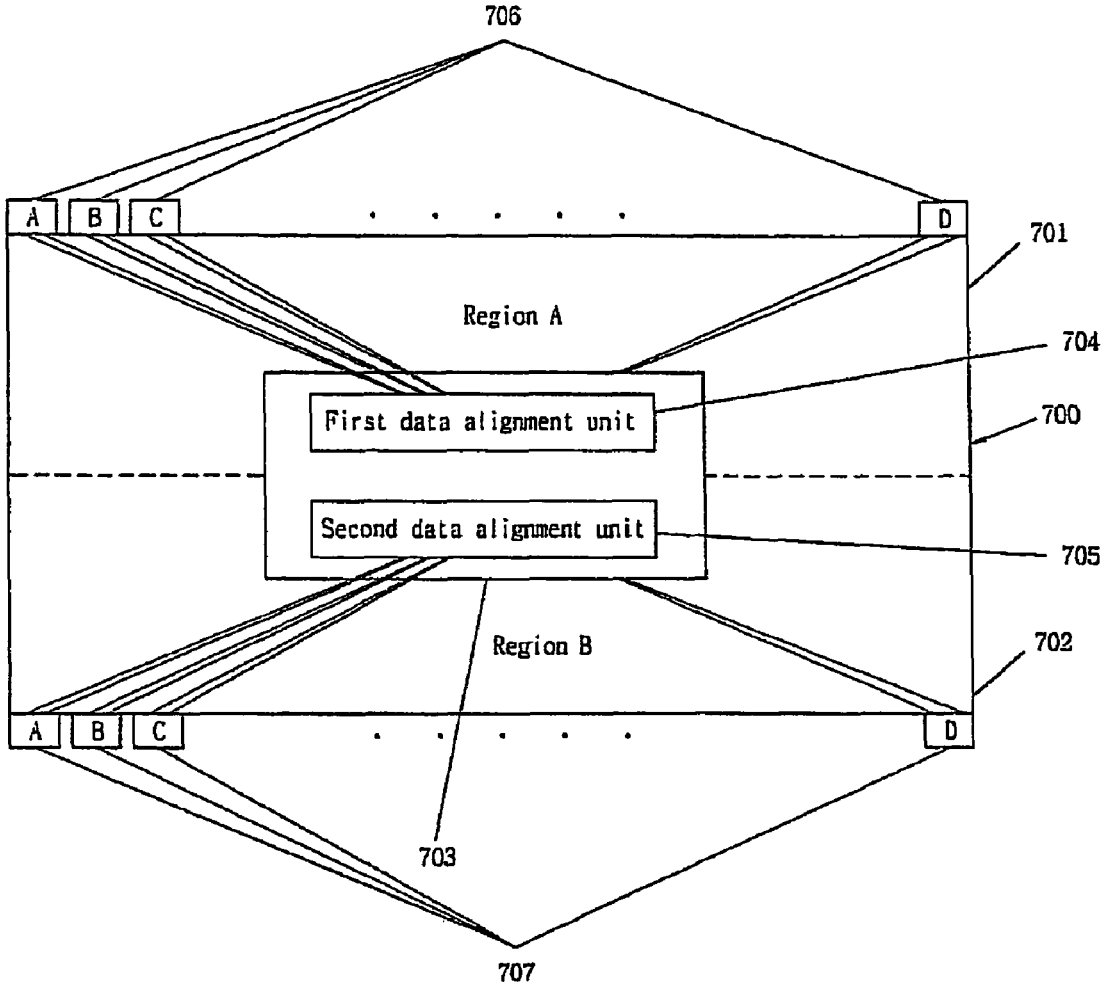
FIG. 7 is a diagram illustrating a method of matching data signals supplied to two regions of a plasma display panel according to an example arrangement.

Accordingly, the supply directions of the data signals supplied from the second data alignment unit 605 may be set opposite to the supply direction of the data signals supplied from the first data alignment unit 604. This will be described with reference to FIG. 7. More specifically, FIG. 7 is a diagram illustrating a method of matching data signals supplied to two regions of a plasma display panel according to an example arrangement. Other arrangements are also possible.

As shown in FIG. 7, supply directions of data signals supplied to address electrodes in the region B 702 from a second data alignment unit 705 for aligning the data signals to be supplied to a region B 702 on a plasma display panel 700 are opposite to supply directions of signals supplied from a first data alignment unit 704. However, the first data alignment unit 704 and the second data alignment unit 705 may have substantially a same structure. Thus, if the data supply directions of the first data alignment unit 704 and the second data alignment unit 705 are opposite to each other as shown in FIG. 7, the data signals supplied (or applied) to the address electrodes do not match each other. For example, a data signal identical to a data signal supplied from the first data alignment unit 704 to the data drive IC A 706 of the region A 701 may be supplied from the second data alignment unit 705 to the data drive IC D of the data drive ICs 707 in the region B 702.

In order to deal with unmatched data signals, a sequence of the data signals may be controlled in the second data alignment unit 705. This method will be described below with reference to FIGS. 8*a* to 8*c*.

Figure 8A:
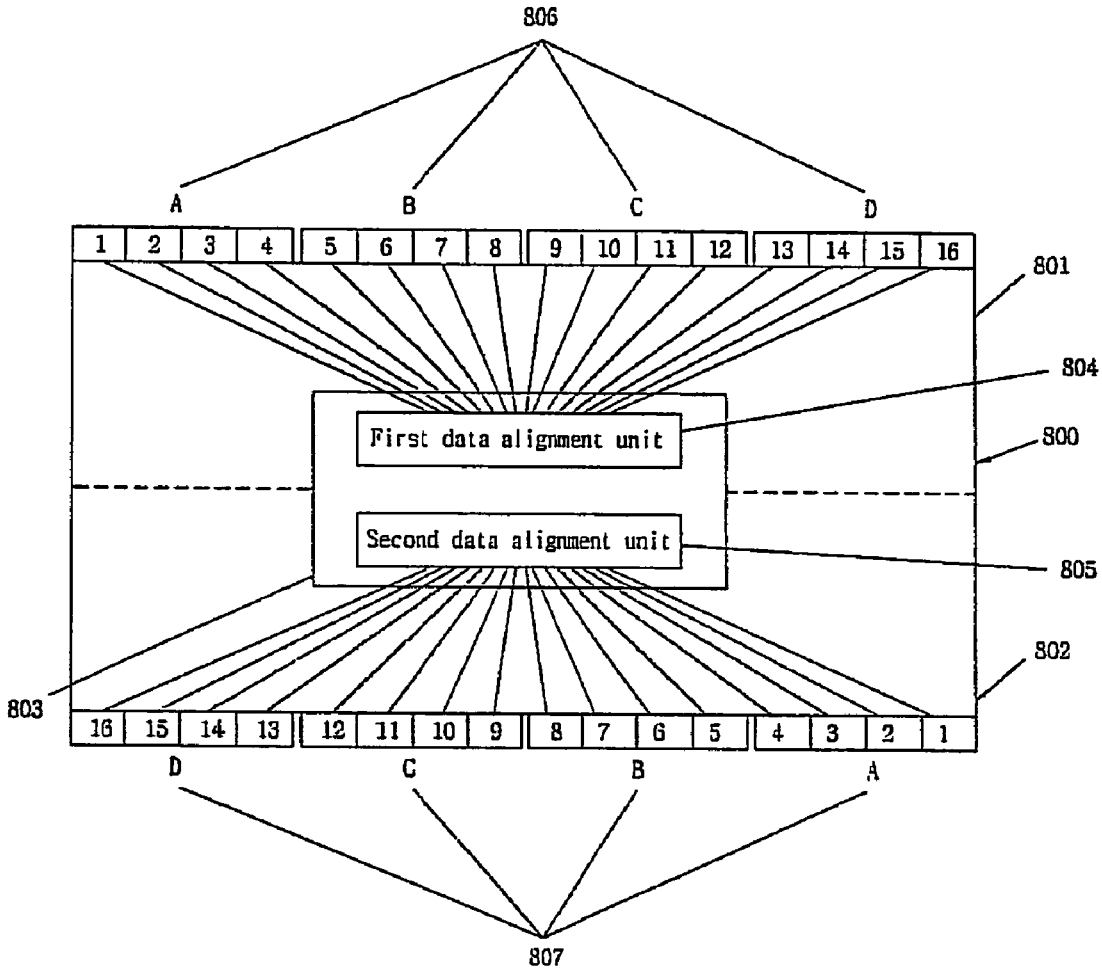
FIGS. 8*a* to 8*c* illustrate a sequence of data signals so as to match data signals according to an example arrangement.
Figure 8B:
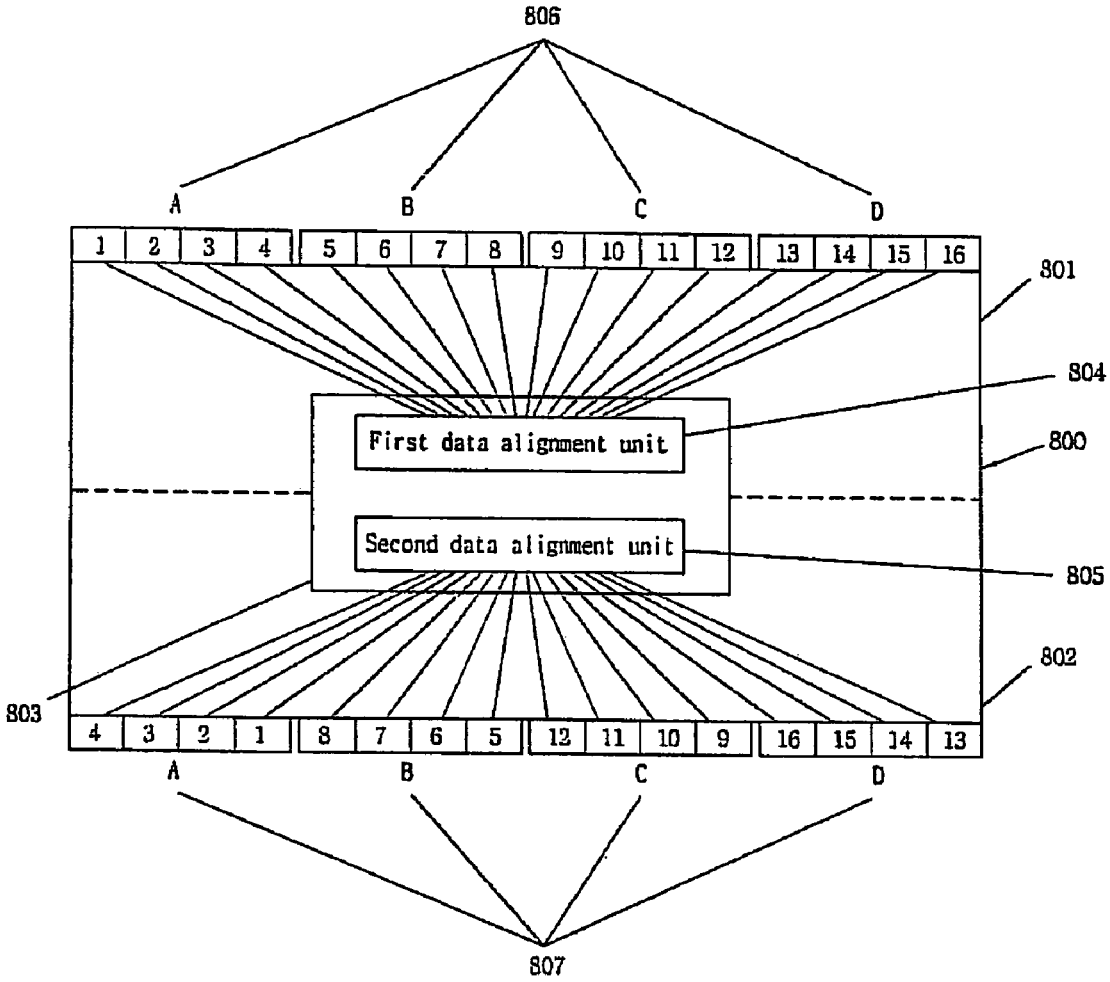
Figure 8C:
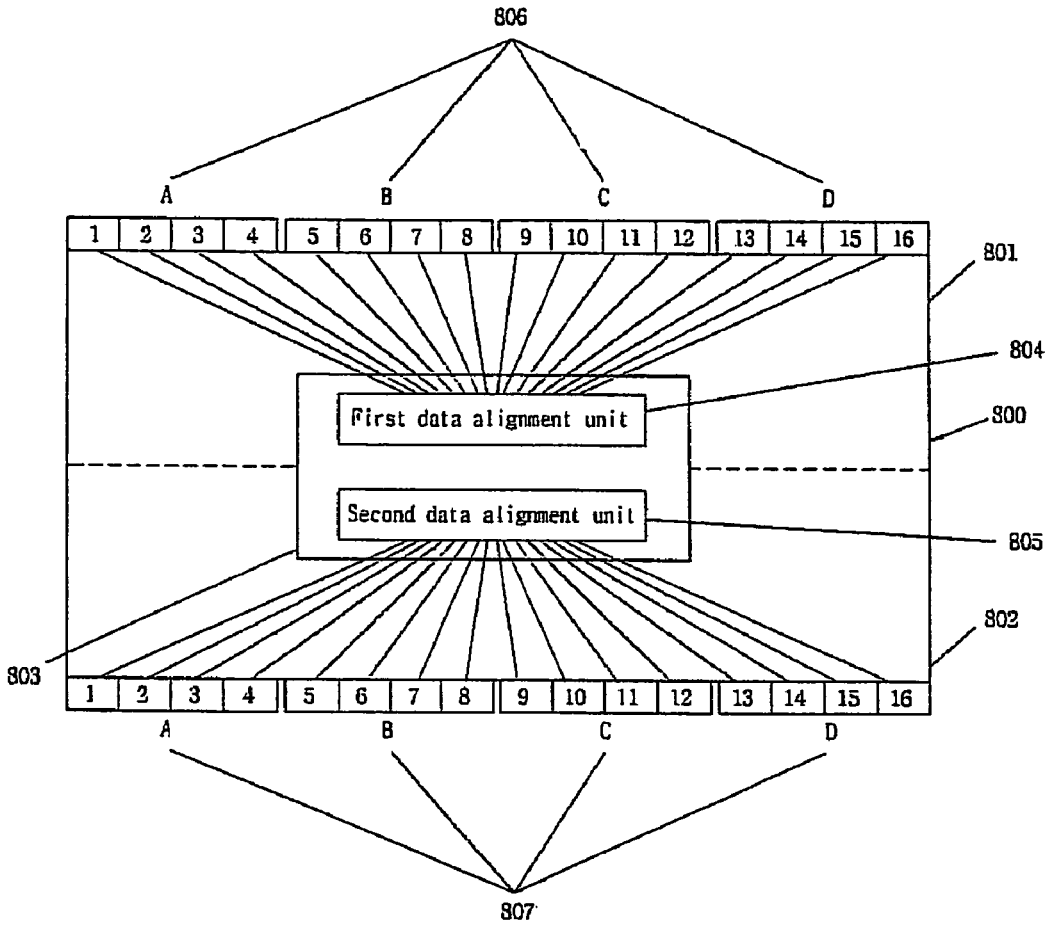

FIGS. 8*a* to 8*c* illustrate controlling sequence of data signals so as to match data signals according to an example arrangement. Other arrangements are also possible.

FIG. 8*a* illustrates data supply paths before a sequence of data signals is controlled. That is, a plasma display panel 800 may be driven in a state of being divided into two regions 801 and 802. If data drive ICs for supplying data signals to the region 801 are set to a total of four data drive ICs A, B, C and D 806 and data drive ICs for supplying data signals to the region 802 are set to a total of four data drive ICs A, B, C and D 807, then the data supply directions of the first data alignment unit 804 and the second data alignment unit 805 may be opposite to each other. Consequently, the data signals supplied to the data drive ICs A, B, C and D 806 and the data signals supplied to the data drive ICs A, B, C and D 807 are opposite to each other.

As shown with respect to FIG. 8*b*, in order to match the opposite data of FIG. 8*a*, the sequence of data supplied to the data drive ICs A, B, C and D 807 that receive the data signals from the second data alignment unit 805 may be reversed. That is, in FIG. 8*a*, a data signal to be applied to the data drive IC D and a data signal to be applied to the data drive IC A are exchanged with each other, and a data signal to be applied to the data drive IC C and a data signal to be applied to the data drive IC B are exchanged with each other.

As shown with respect to FIG. 8*c*, a supply sequence of data that are exchanged on a data-drive-IC basis in FIG. 8*b* is changed in each data drive IC. For example, in FIG. 8*b*, data supplied to the data drive IC 807 have a sequence of 4, 3, 2 and 1. This sequence of the data is opposite to the sequence of data of the data drive IC A 806. Accordingly, the sequence of the data supplied to the data drive IC A 807 is reversed to the sequence of 1, 2, 3 and 4 in FIG. 8*c*.

As a result, data signals supplied from the first data alignment unit 804 and data signals supplied from the second data alignment unit 805 may be matched via a two-step data correction process (or hereafter called a data correction process).

However, this method of matching data signals through the two-step data correction process may be applied only to a case where a total number of electrode lines of a plasma display panel and a total number of channels included in all of the data drive ICs are the same. For instance, when a total number of discharge cells is 1920 in the lengthwise direction of the plasma display panel, address electrode lines may therefore be generally provided for red, green and blue colors. The total number of address electrode lines may therefore be 1920×3=5760. In an example where data drive ICs each having 192 channels are used, the total number of address electrode lines may be 192×30=5760 when a total of 30 data drive ICs are used. Accordingly, the method of FIGS. 8*a* to 8*c* can be used.

However, if one data drive IC has 256 channels and a total number of address electrode lines of one plasma display panel is 5760, data signals can be applied to the 5760 address electrode lines only when the number of data drive ICs is at least 23. This case will be described below with reference to FIG. 9.

Figure 9:
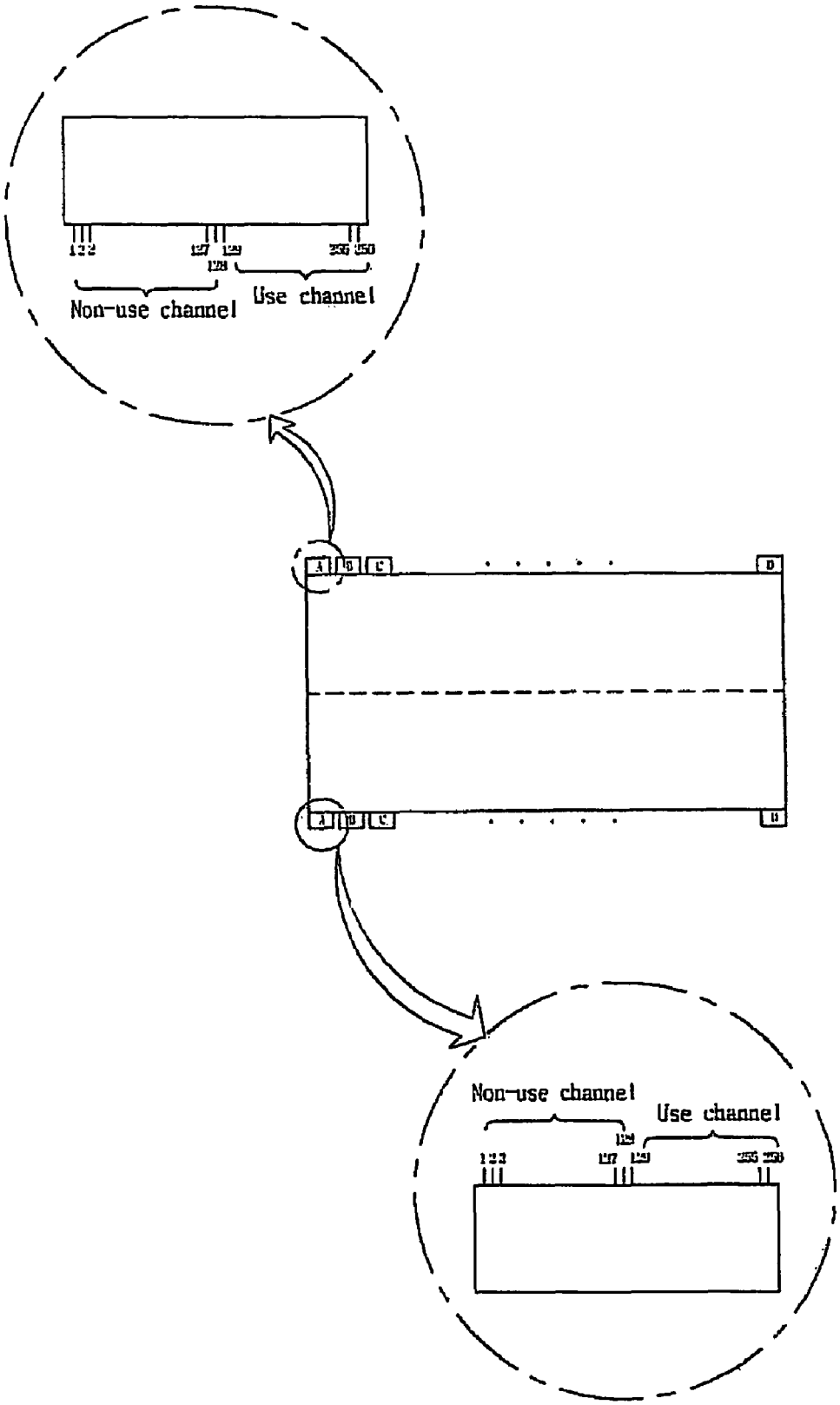
FIG. 9 is a diagram illustrating an example in which one data drive IC includes 256 channels according to an example arrangement.

FIG. 9 is a diagram illustrating an example in which one data drive IC includes 256 channels according to an example arrangement. As shown in FIG. 9, assuming that the plasma display panel has a total of 5760 address electrode lines and each data drive IC has 256 channels, at least 23 data drive ICs are needed. That is, when the number of data drive ICs each having the 256 channels is 22, a total of 256×22=5632 channels may be provided. Therefore, data signals cannot be applied to all the address electrode lines. On the other hand, if the number of data drive ICs is 23, then a total of 256×

23=5888 channels may be provided. Data signals can be applied to all of the address electrode lines.

However, when the total number of data drive ICs each having the 256 channels is 23, the number of channels exceeds the number of address electrode lines by 128. In order to process the surplus channels, the number of which corresponds to a number by which the number of channels exceeds the total number of address electrode lines in any one data drive IC, non-use channels are provided as shown in FIG. 9. For example, channels from a first channel to a $128^{th}$ channel in any one data drive IC can be set as non-use channels, and channels starting with the $129^{th}$ channel can be set as use channels. The channels that are set as use channels as described above may be electrically connected to the address electrodes of the plasma display panel, whereas the channels that are set as non-use channels may not be connected to the address electrodes.

Figure 10A:
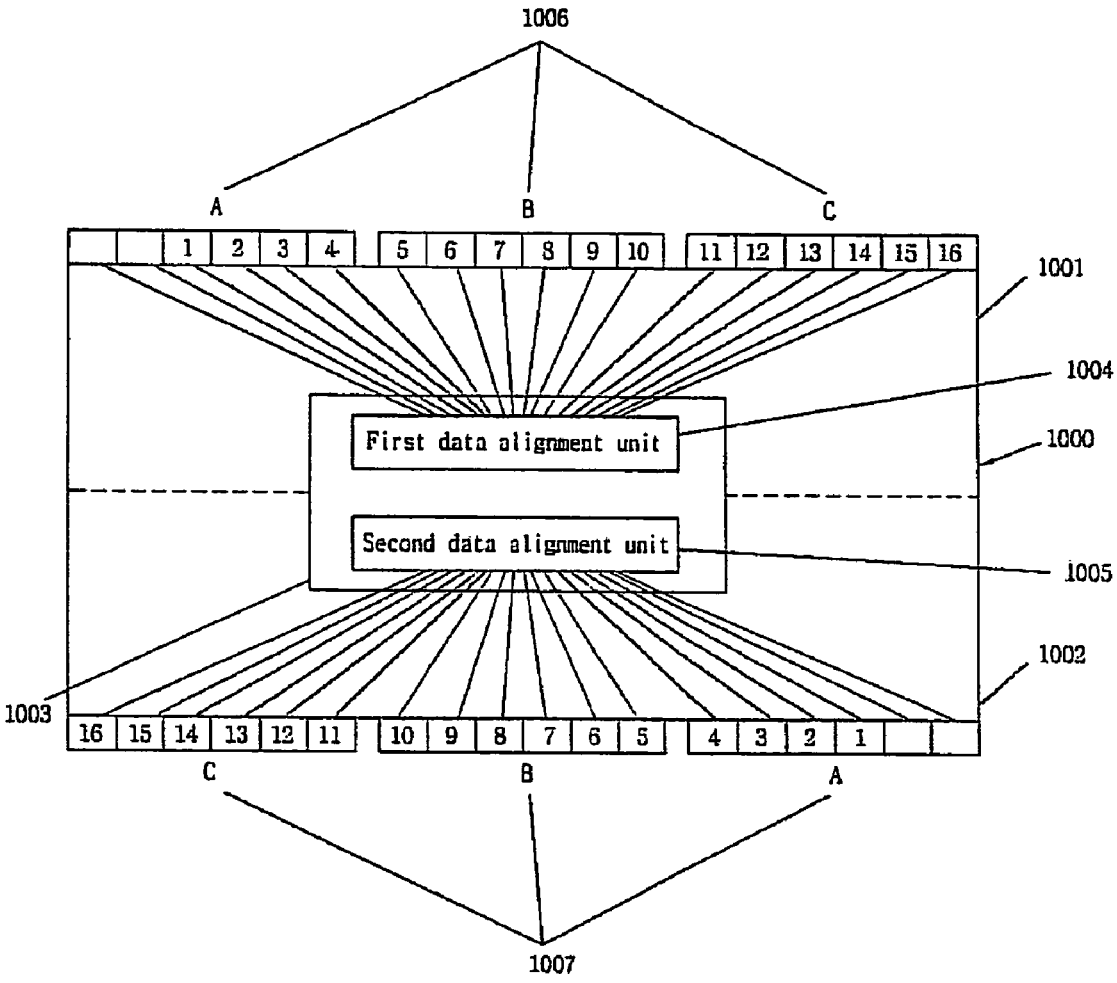
FIGS. 10*a* to 10*c* are diagrams illustrating controlling a sequence of data signals so as to match the data signals in the arrangement of FIG. 9 according to an example arrangement.
Figure 10B:
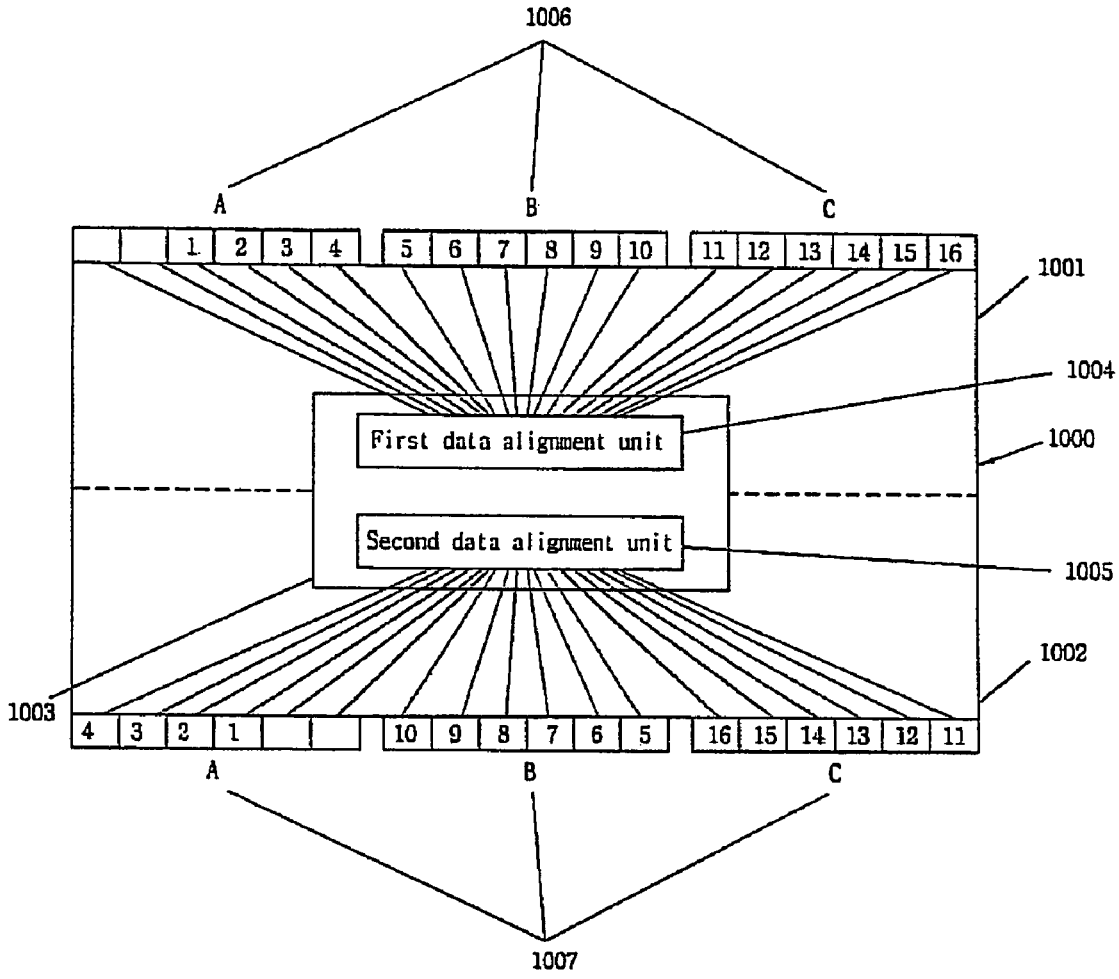
Figure 10C:
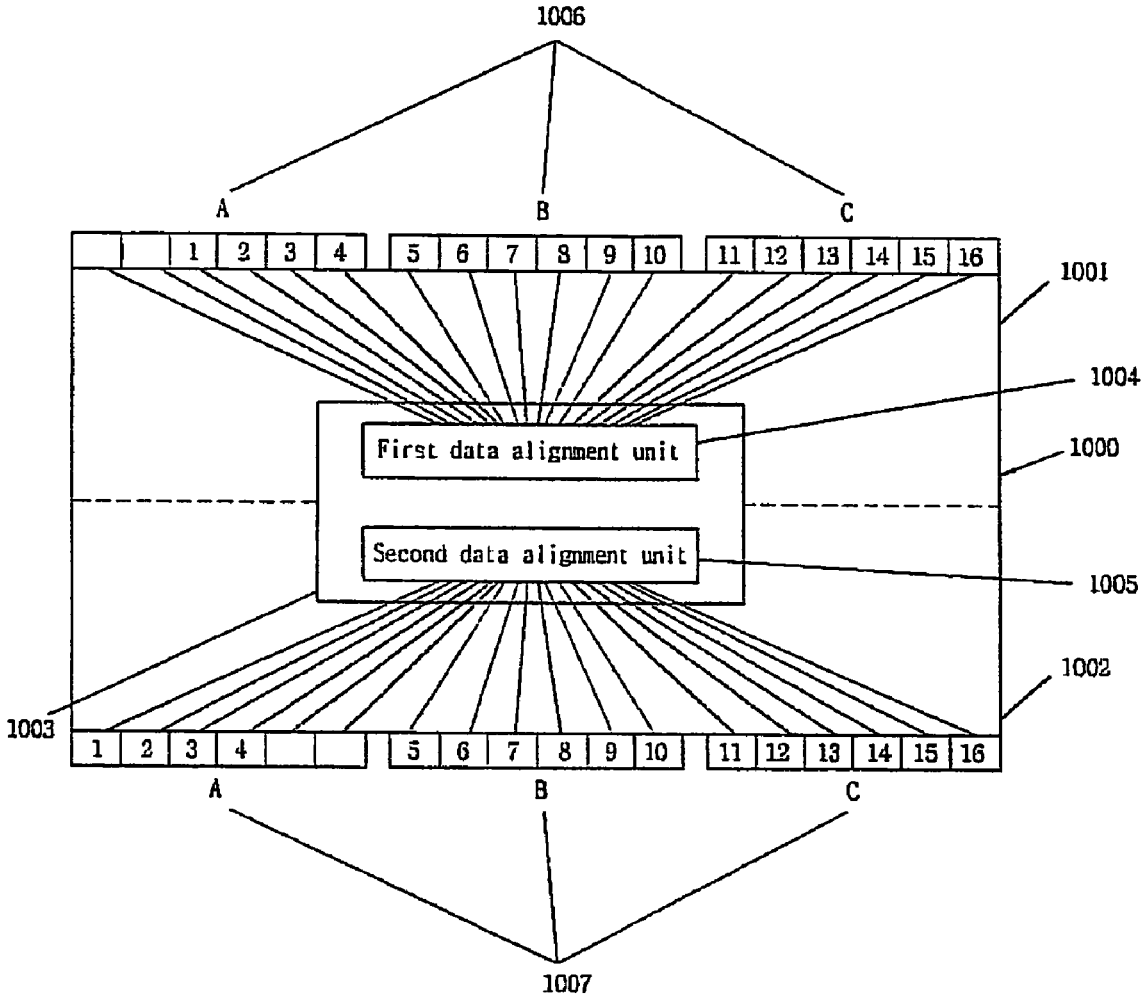

A method of controlling the sequence of data signals in order to match the data signals is described below with reference to FIGS. 10*a* to 10*c*. More specifically, FIGS. 10*a* to 10*c* are diagrams illustrating controlling a sequence of data signals so as to match the data signals in the arrangement of FIG. 9 according to an example arrangement. Other arrangements are also possible.

As shown in FIG. 10*a*, unlike the arrangement of FIG. 8*a*, there exist channels to which data signals are not applied in the data drive IC A. For example, data signals may not be applied to first and second channels in the data drive IC A 1006. That is, the first and second channels in the data drive IC A 1006 may be set as non-use channels (or dummy channels). FIGS. 10*a* to 10*c* illustrate an example where a total number of data drive ICs is 6 and six channels are included in each of the data drive ICs. These numbers are merely used as examples.

In this arrangement, as in FIG. 8*a*, when the data supply directions of a first data alignment unit 1004 and a second data alignment unit 1005 are opposite to each other, data may not be supplied to fifth and sixth channels in data drive IC A 1007, and data signals may not match each other.

As shown in FIG. 10*b*, in order to match the opposite data of FIG. 10*a*, the sequence of data supplied to the data drive ICs A, B and C 1007 that receive data signals from the second data alignment unit 1005 may be reversed. That is, in FIG. 10*a*, the data signals to be applied to the data drive IC C and the data signals to be applied to the data drive IC A are exchanged with each other.

In FIG. 10*c*, a supply sequence of the data that are exchanged in every data drive IC of FIG. 10*b* is changed in each data drive IC. For example, in FIG. 10*b*, the sequence of data supplied to the data drive IC A 1007 is 4, 3, 1, and 1, which is opposite to that of the data drive IC A 1006. Therefore, the sequence of the data supplied to the data drive IC A 1007 is reversed in FIG. 10*c* to the sequence of 1, 2, 3 and 4.

The arrangement sequence of the data of the data drive IC A 1007 is 1, 2, 3 and 4, which is the same as that of the data drive IC A 1006 in FIG. 10*c*, but the positions of non-use channels are opposite to each other. Thus, the data signals supplied by the data drive IC A 1006 and the data signals supplied by the data drive IC A 1007 are mismatched. Accordingly, the data of the data drive IC A 1007 are shifted towards the right by two steps in order to match the data signals.

However, in this method, a data processing process may be excessively complicated, and errors may be generated in the data processing process. Thus, there is a possibility that picture quality may degrade. Furthermore, there is a problem that reliability of a plasma display panel can be degraded due to errors generated in the process of electrically connecting the data drive ICs to the address electrode lines.

A plasma display apparatus according to example embodiments of the present invention will now be described.

Figure 11:
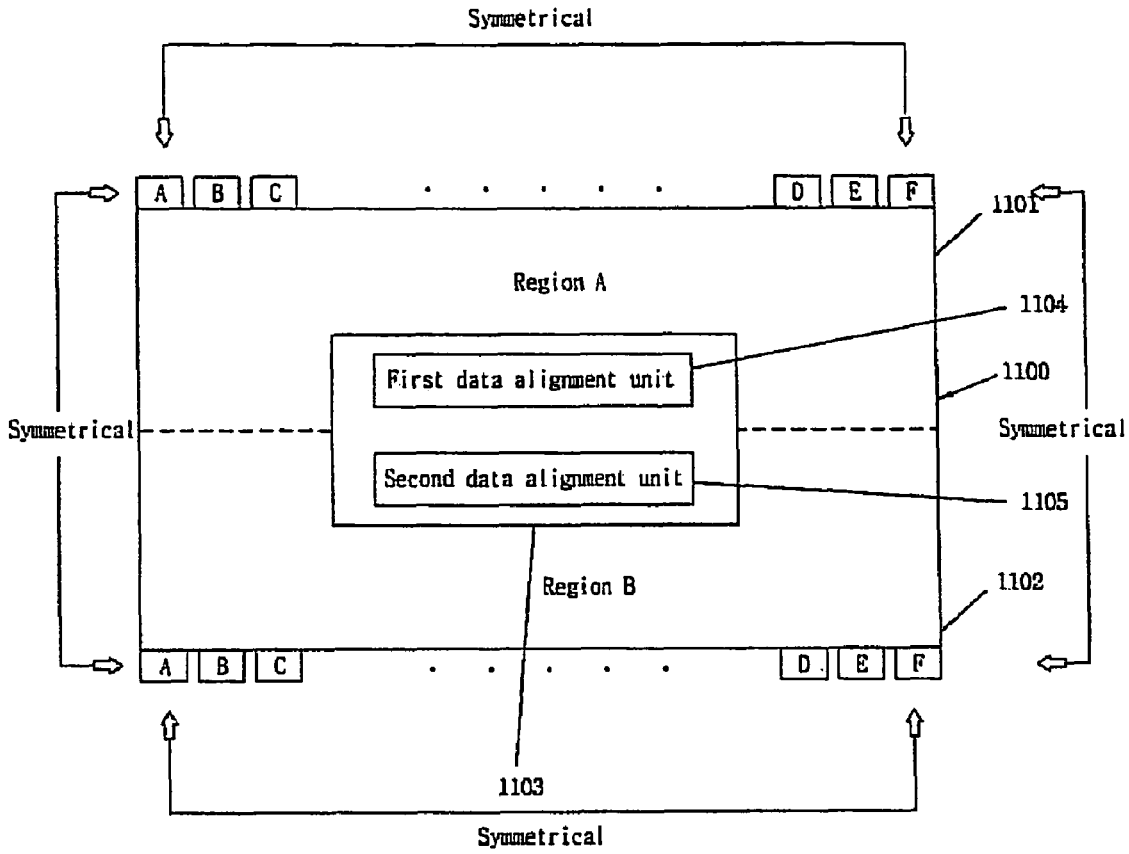
FIG. 11 is a diagram illustrating a plasma display apparatus according to an example embodiment of the present invention.

FIG. 11 is a diagram illustrating a plasma display apparatus according to an example embodiment of the present invention. Other embodiments and configurations are also within the scope of the present invention. More specifically, the plasma display apparatus may include a plasma display panel 1100, a plurality of data drive ICs each having a plurality of channels, a first data alignment unit 1104 and a second data alignment unit 1105.

The plasma display panel 1100 has a plurality of address electrodes formed therein. The plasma display panel 1100 is driven with its screen region divided into a first screen region and a second screen region (e.g., a region A 1101 and a region B 1102). Address electrodes corresponding to the first screen region are referred to as "a first address electrode group" and address electrodes corresponding to the second screen region are referred to as "a second address electrode group".

The first data alignment unit 1104 applies aligned data signals to data drive ICs (A, B, C, . . . , D, E and F) connected to the address electrodes of the region A 1101 on the plasma display panel 1100 (i.e., the first address electrode group). Data drive ICs A connected to the address electrode group corresponding to the region A 1101 of the screen region of the plasma display panel 1100 may be referred to as "first data drive ICs" or "a first plurality of data drive ICs."

The second data alignment unit 1105 applies aligned data signals to data drive ICs (A, B, C, . . . , D, E and F) connected to the address electrodes of the region B 1102 on the plasma display panel 1100 (i.e., the second address electrode group). Data drive ICs A connected to the address electrode group corresponding to the region B 1102 of the screen region of the plasma display panel 1100 may be referred to as "second data drive ICs" or "a second plurality of data drive ICs."

The number of data drive ICs (i.e., the number of channels of the first data drive ICs and the number of channels of the second data drive ICs) are preferably the same.

Furthermore, the plurality of data drive ICs A, B, C, D, E and F including the plurality of channels are electrically connected to the address electrodes (i.e., the first address electrode group and the second address electrode group) in the two regions (i.e., the region A 1101 and the region B 1102) of the plasma display panel 1100. The plurality of channels in one or more of the plurality of data drive ICs are divided into dummy channels and valid channels.

"Dummy channels" refers to channels that are not connected to the first and second address electrode groups or to which data are not supplied. Furthermore, "valid channels" refers to channels other than the dummy channels.

If the nth channel of the first data drive IC, which is connected to the first address electrode group corresponding to the first screen region (i.e., the A region 1101) of the plasma display panel 1100, from one side of the first screen region (i.e., the A region 1101) is a dummy channel, an nth channel from the other side of the first screen region (i.e., the region A 1101) is also a dummy channel, and the nth channel of the second data drive IC from one side of the second screen region (i.e., the region B 1102) that matches the one side of the first screen region is also a dummy channel. For example, if a third channel from the left end in the first screen region (i.e., the region A 1101) of the plasma display panel 1100 is a dummy channel, a third channel from the right end of the region A 1101 is also a dummy channel. Further, a third channel from the left end of the second screen region (i.e., the region B 1102) of the plasma display panel 1100 is also a dummy channel.

If the plasma display panel 1100 has a symmetrical structure around a center thereof, a data drive IC having valid channels and dummy channels has a structure in which the dummy channels are symmetric to other data drive ICs horizontally and vertically around a center of the plasma display panel 1100. For example, in the FIG. 11 embodiment, the data drive IC A of the first data drive ICs that receives aligned data from the first data alignment unit 1104 and supplies the data to the address electrodes (i.e., the first address electrode group) of the region A 1101 has a structure in which the arrangement of the dummy channels is symmetrical to (i.e., the same as) the data drive IC F of the first data drive ICs of the same region (i.e., the region A 1101), and the data drive IC A also has a structure in which the arrangement of the dummy channels is symmetrical to (i.e., the same as) the data drive IC A of the second data drive ICs that receives aligned data from the second data alignment unit 1105 and supplies the data to the address electrodes (i.e., the second address electrode group) of the second screen region (i.e., the region B 1102). In this case, "symmetrical" means "the same as" because the arrangement of the dummy channel is horizontally symmetrical within one data drive IC. That is, the arrangement of use channels is horizontally symmetrical within data drive ICs in which a plurality of channels are divided into valid channels and dummy channels. That is, when a first channel is set as a dummy channel within one data drive IC, the last channel is also set as a dummy channel.

Consequently, a total number of dummy channels of the first data drive ICs in the first screen region (i.e., the region A 1101) of the plasma display panel 1100 is preferably the same as a total number of dummy channels of the second data drive ICs in the second screen region (i.e., the region B 1102).

As described above, the number of data drive ICs arranged in the first screen region and the second screen region (i.e., the region A 1101 and the region B 1102) of the plasma display panel 1100 may be at least four.

Also, the number of channels of an mth first data drive IC from one side of the first screen region (i.e., the region A 1101) of the screen region of the plasma display panel 1100 is the same as the number of channels of an mth first data drive IC from the other side of the first screen region and the number of channels of an mth second data drive IC from one side in the second screen region that matches the one side of the first screen region.

As an example, in FIG. 11, the number of channels included in the data drive IC A of the first data drive ICs, which receives aligned data from the first data alignment unit 1104 and supplies the data to the address electrodes (i.e., the first address electrode group) of the region A 1101, is the same as the number of channels included in the data drive IC F of the first data drive ICs of the same region (i.e., the region A 1101). This number of channels is also the same as the number of channels included in the data drive IC A of the second data drive ICs that receive aligned data from the second data alignment unit 1105 and supply the data to the address electrodes (i.e., the second address electrode group) of the second screen region (i.e., the region B 1102).

Also, one or more of the plurality of first data drive ICs and one or more of the plurality of second data drive ICs have one or more dummy channels, respectively.

Furthermore, the number of dummy channels of one of the first data drive ICs, which includes one or more dummy channels and is located at an mth location from one side of the first screen region, is the same as the number of dummy channels of another first data drive IC, which includes one or more dummy channels and is located at an mth location from the other side of the first screen region, and is the same as the number of dummy channels of one of the second data drive ICs, which includes one or more dummy channels and is located at an mth location from one side in the second screen region, which matches the one side of the first screen region.

For example, if 10 dummy channels are included in each of four of the first data drive ICs, which are arranged in the first screen region (i.e., the region A 1101) of the plasma display panel 1100, at both ends (two at each end) of the region A 1101, 10 dummy channels may be included in each of four of the second data drive ICs, which are arranged in the second screen region (i.e., the region B 1102) of the plasma display panel 1100 at both ends (two at each end) of the region B 1102.

The arrangement of dummy channels of one of the first data drive ICs, which includes one or more dummy channels and is located at an mth location from one side of the first screen region, may be the same as the arrangement of dummy channels of one of the first data drive ICs, which includes one or more dummy channels and is located at an mth location from the other side of the first screen region, and also may be the same as the arrangement of dummy channels of one of the second data drive ICs, which includes one or more dummy channels and is located at an mth location from one side in the second screen region that matches the side of the first screen region.

For example, if dummy channels are arranged in a predetermined pattern in four of the first data drive ICs, which are arranged in the first screen region (i.e., the region A 1101) of the plasma display panel 1100, at both ends (two at each end) of the region A 1101, then dummy channels are arranged in the same pattern as that of the dummy channels within four of the second data drive ICs, which are arranged in the second screen region (i.e., the region B 1102) of the plasma display panel 1100, at both ends (two at each end) of the region A 1101 in the four of the second data drive ICs at both ends (two at each end) of the region B 1102.

As described above, the arrangement of the dummy channels may be symmetrical within data drive ICs each having one or more dummy channels. For example, if two of the ten channels of the data drive IC at one side end are dummy channels in the case where one data drive IC has a total of ten channels, then two channels at the other side end of the data drive IC are also dummy channels. The arrangement of the dummy channels within one data drive IC may be horizontally symmetrical.

Most preferably, the arrangement of the dummy channels in the first screen region (i.e., the region A 1101) of the plasma display panel 1100 may be horizontally symmetrical. The arrangement of the dummy channels in the second screen region (i.e., the region B 1102) may also be horizontally symmetrical. The arrangement of the dummy channels in the first screen region (i.e., the region A 1101) and the arrangement of the dummy channels in the second screen region (i.e., the region B 1102) may be symmetrical around a border (or center area) that divides the first screen region (i.e., the region A 1101) and the second screen region (i.e., the region B 1102).

Furthermore, all dummy channels may be included in one of the first data drive ICs located at one side end of the first screen region (i.e., the region A 1101) and another data drive IC located at the other side end of the first screen region (i.e., the region A 1101). Further, all dummy channels may be included in one of the second data drive ICs located at one side end of the second screen region (i.e., the region B 1102)

and another second data drive IC located at the other side end of the second screen region (i.e., the region B 1102).

As an example, in FIG. 11, assuming that the total number of dummy channels of the first data drive ICs including channels connected to the address electrodes (i.e., the first address electrode group) of the first screen region (i.e., the region A 1101) of the plasma display panel 1100 is 100, then a total of 100 dummy channels may be included. That is, 50 dummy channels may be included in the data drive IC A at one side end of the region A 1101 and 50 dummy channels may be included in the data drive IC F at the other side end of the region A 1101. Further, assuming that the total number of dummy channels of the second data drive ICs including channels connected to address electrodes (i.e., the second address electrode group) of the second screen region (i.e., the region B 1102) of the plasma display panel 1100 is 100, then a total of 100 dummy channels may be included. That is, 50 dummy channels may be included in the data drive IC A of the second data drive ICs at one side end of the region B 1102 and 50 dummy channels may be included in the data drive IC F of the second data drive ICs at the other side end of the region B 1102.

The driving method of the plasma display apparatus according to an example embodiment of the present invention may include applying data to a plurality of first data drive ICs, rearranging the data so that second region data applied from a plurality of second data drive ICs to a second address electrode group match first region data applied from the first data drive ICs to a first address electrode group, and applying the rearranged data to the plurality of second data drive ICs.

The rearranging of the data will now be described in more detail. The rearranging of the data includes reversing the first region data to data respectively corresponding to the plurality of first data drive ICs, and reversing the first region data that were previously reversed to the data respectively corresponding to the plurality of first data drive ICs for every first data drive IC.

In the driving method of the plasma display apparatus according to an example embodiment of the present invention, reversing the data will be described with reference to FIGS. 12*a* to 12*c*.

Figure 12A:
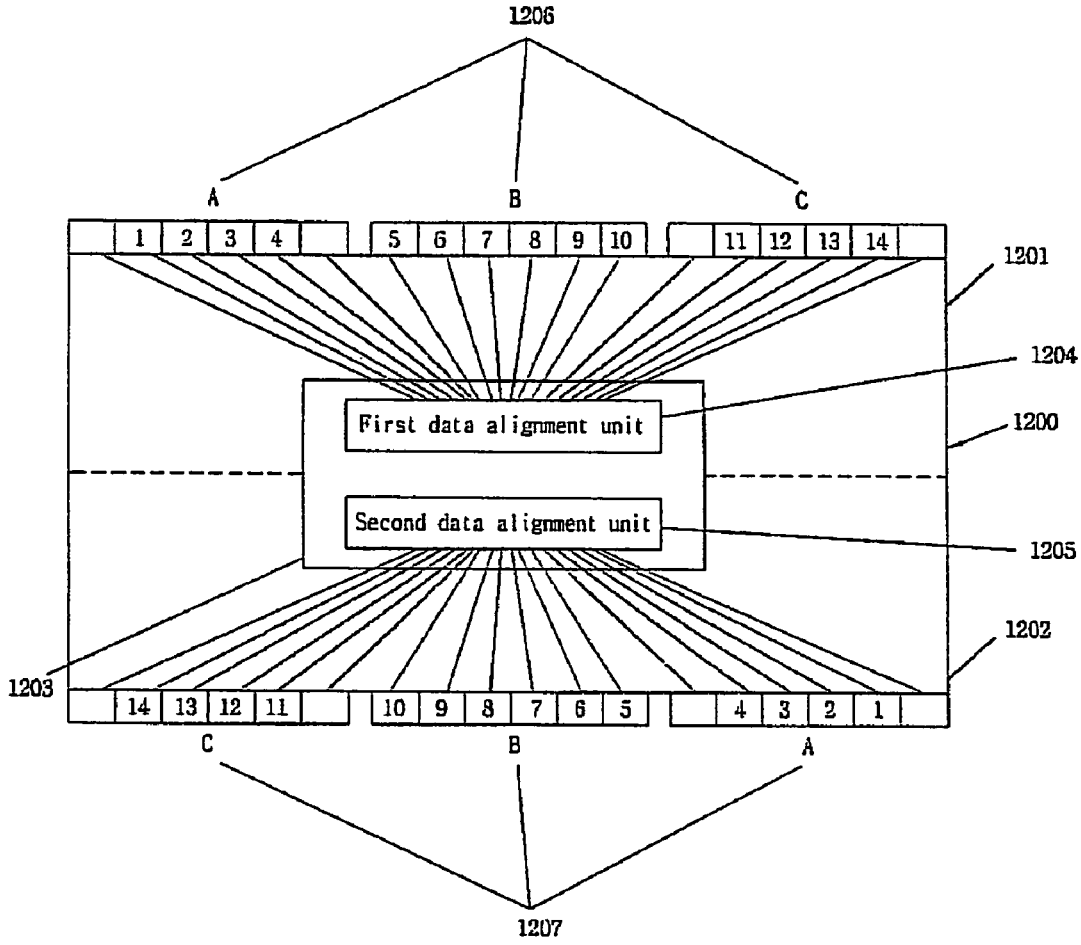
FIGS. 12*a* to 12*c* are diagrams illustrating controlling and driving a sequence of data signals in order to match data signals in the plasma display apparatus of FIG. 11 according to an example embodiment of the present invention.
Figure 12B:
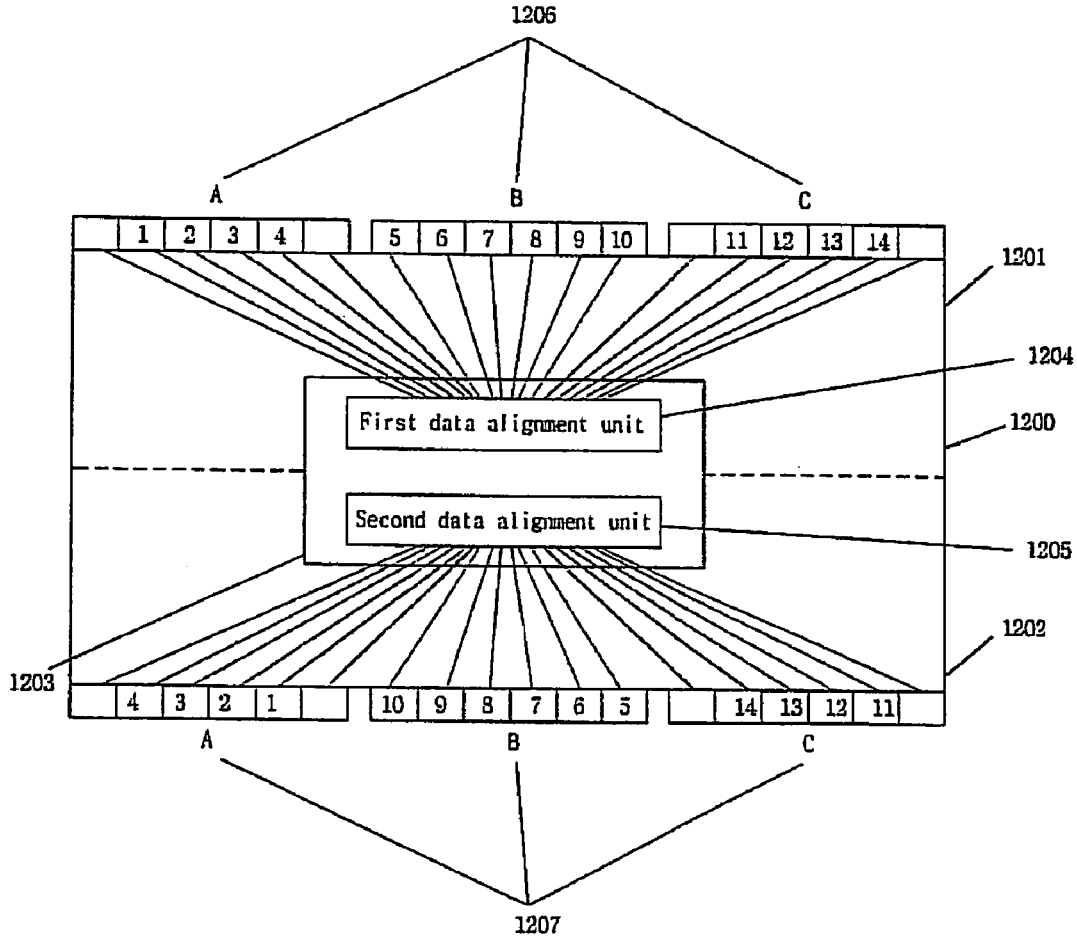
Figure 12C:
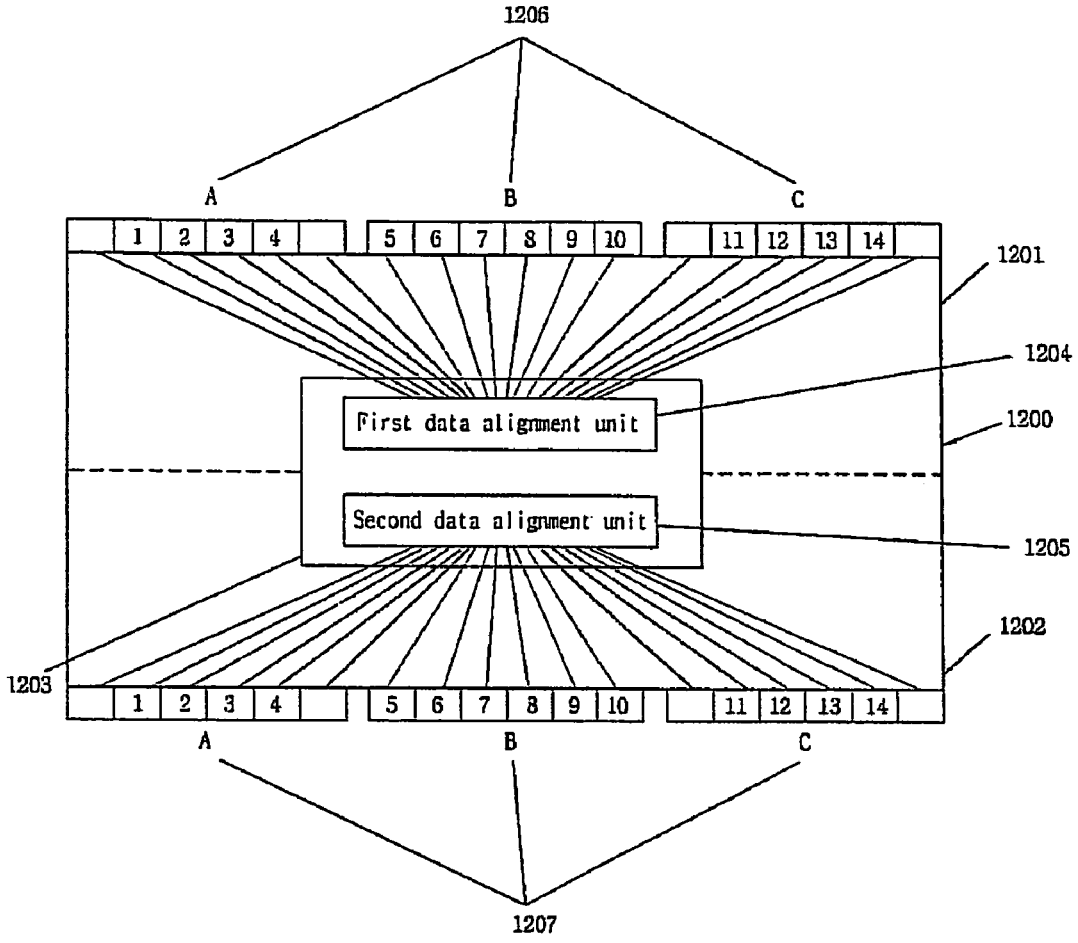

FIGS. 12*a* to 12*c* are diagrams illustrating controlling and driving a sequence of data signals in order to match data signals in the plasma display apparatus of FIG. 11 according to an example embodiment of the present invention. Other embodiments and configurations are also within the scope of the present invention.

FIG. 12*a* shows data supply paths before the sequence of data signals is controlled. That is, in the arrangement where one plasma display panel 1200 is driven in a state of being divided into two regions (i.e., a first screen region 1201 and a second screen region 1202), data drive ICs for supplying data signals to the region 1201 may be set to three data drive ICs A, B and C 1206, data drive ICs for supplying data signals to the region 1202 may be set to three data drive. ICs A, B and C 1207, and each of the data drive ICs has six channels. In such an arrangement, data supply directions of the first data alignment unit 1204 and the second data alignment unit 1205 are opposite to each other. In this arrangement, the data signals applied to the data drive ICs A, B, C 1206 and the data signals applied to the data drive ICs A, B and C 1207 are opposite to each other. At this time, the structure of use channels of the data drive IC A 1206 is symmetrical (i.e., the same as) to the structure of use channels of the data drive IC C 1206, the data drive IC A 1207 and the data drive IC C 1207. More specifically, in the data drive IC A 1206, a first channel and a sixth channel of a total of six channels are set as dummy channels, and a second channel to a fifth channel in a central portion thereof are set as valid channels. Furthermore, the data drive IC C 1206, the data drive IC A 1207 and the data drive IC C 1207 have a same arrangement as channels of the data drive IC A 1206.

In FIG. 12*b*, the driving method of the plasma display apparatus according to the present invention may include reversing the first region data to the data respectively corresponding to the plurality of first data drive ICs.

For example, in order to match opposite data in FIG. 12*a*, the sequence of data supplied to the data drive ICs A, B and C 1207 that receive the data signals from the second data alignment unit 1205 is reversed. That is, in FIG. 12*a*, data signals to be applied to the data drive IC C and data signals to be applied to the data drive IC A are exchanged, but data signals to be applied to the B data drive IC remain intact.

FIG. 12*c* shows an example of reversing the first region data, which were previously reversed to the data respectively corresponding to the plurality of first data drive ICs in FIG. 12*b*, for every first data drive IC.

In FIG. 12*c*, the sequence of the data that have been exchanged for every data drive IC in FIG. 12*b* is changed within each of the data drive ICs. For example, in FIG. 12*b*, the sequence of the data supplied to the data drive IC A 1207 is 4, 3, 2 and 1. This sequence of data is opposite to that of the data drive IC A 1206. Accordingly, the sequence of the data supplied to the data drive IC A 1207 in FIG. 12*b* is reversed to have the sequence of 1, 2, 3 and 4 as shown in FIG. 12*c*.

As a result, even when a total number of electrode lines of a plasma display panel and a total number of channels included in all of the data drive ICs are different from each other, data signals supplied from the first data alignment unit 1204 and data signals supplied from the second data alignment unit 1205 can be matched through a data correction process. This can simplify the data processing process as compared to previous and/or disadvantageous arrangements.

As described above, if the sequence of data is controlled, data supplied to the first data drive ICs and data supplied to the second data drive ICs can be applied in a same sequence from one side on the plasma display panel.

Figure 13:
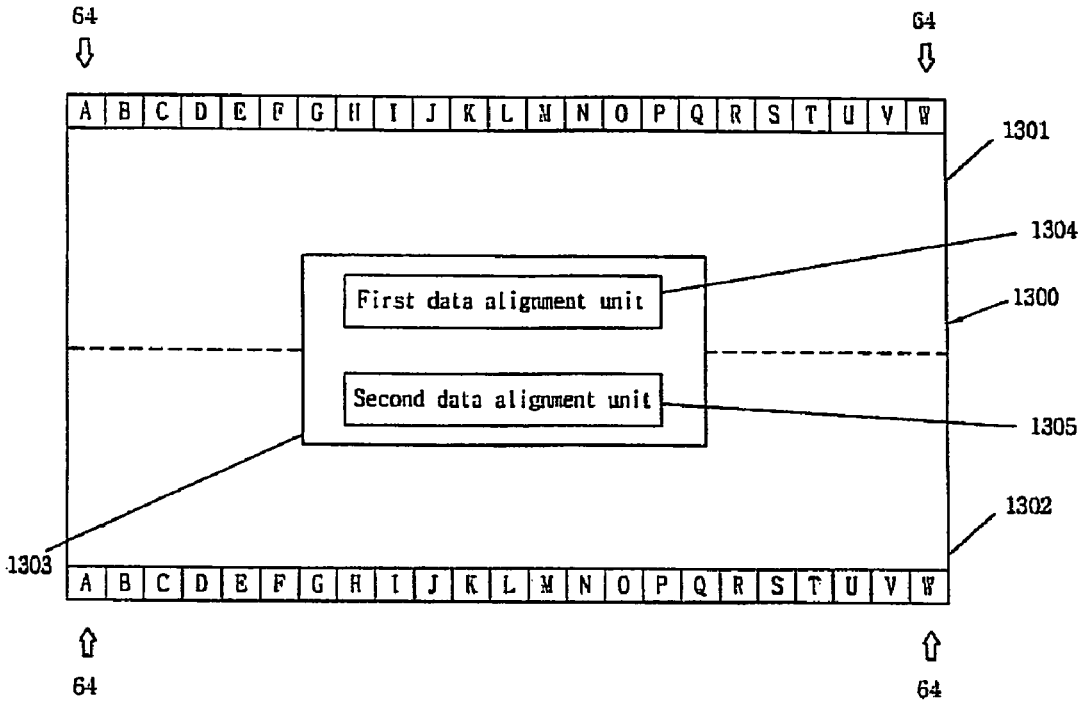
FIG. 13 is a diagram illustrating a method of electrically connecting a plasma display panel having 5760 address electrode lines and data drive ICs each having 256 channels according to an example embodiment of the present invention.

An example will now be described with reference to FIG. 13 in which this method is applied to electrical connections between a plasma display panel having 1920 discharge cells (i.e., 5760 address electrode line) and data drive ICs each having 256 channels. More specifically, FIG. 13 is a diagram illustrating a method of electrically connecting a plasma display panel having 5760 address electrode lines and data drive ICs each having 256 channels according to an example embodiment of the present invention. Other embodiments and configurations are also within the scope of the present invention.

In FIG. 13, one plasma display panel 1300 is divided into two regions (i.e., a first screen region 1301 and a second screen region 1302). 23 data drive ICs are attached to each of the two regions 1301 and 1302. Data signals are applied to address electrodes corresponding to each of the regions 1301 and 1302. Furthermore, data drive ICs for applying data signals to address electrodes corresponding to the region 1301 are supplied with aligned data from a first data alignment unit 1304. Data drive ICs for applying data signals to the region 1302 are supplied with aligned data from a second data alignment unit 1305. The data drive IC A of the data drive ICs for applying the data signals to the address electrodes corresponding to the region 1301 (i.e., a first data drive IC from one side of the plasma display panel 1300) and a data drive IC W (i.e., a first data drive IC from the other side of the plasma display panel 1300) have a same arrangement of dummy channels. In this example, 64 channels are set as dummy channels. Accordingly, the number of use channels of all of the channels of the data drive ICs for applying the data signals to the region 1301 is (256×23)−(64×2)=5760.

Furthermore, the data drive IC A of the data drive ICs for applying the data signals to the region 1301 has a same arrangement of dummy channels as the first (i.e., the data drive IC A) of the data drive ICs, which supplies the data signals to the address electrodes corresponding to the second screen region (i.e., the region 1302) of the screen region of the plasma display panel 1300, from one side end of the region 1302, and also has a same arrangement of dummy channels as that of a first data drive IC (i.e., the data drive IC W) from the other side end of the region 1302.

That is, FIG. 13 shows an example in which a number of data drive ICs is 4 and in which channels are divided into valid channels and dummy channels.

In such an example, the detailed structure of the data drive IC A and the data drive IC W for supplying the data signals to the address electrodes corresponding to the region 1301, and the data drive IC A and the data drive IC W for supplying the data signals to the address electrodes corresponding to the region 1302 is described below with reference to FIG. 14.

Figure 14:
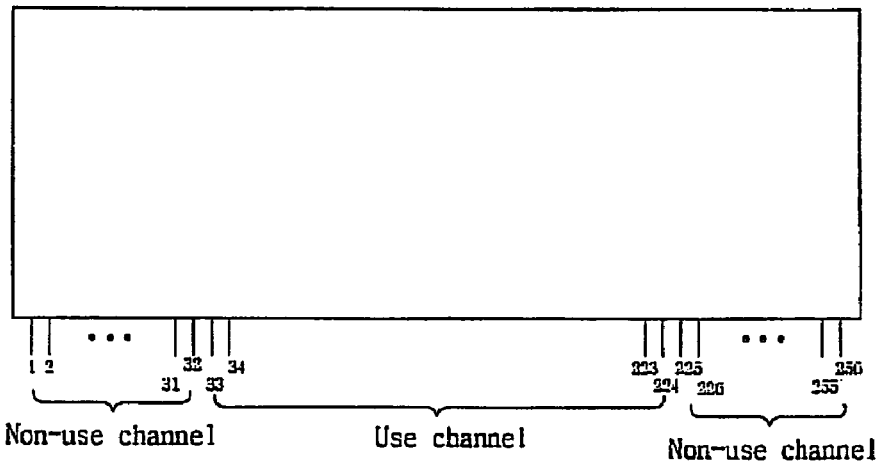
FIG. 14 is a diagram illustrating a structure of a data drive IC in which channels are divided into valid channels and dummy channels in the arrangement of FIG. 13 according to an example embodiment of the present invention.

FIG. 14 is a diagram illustrating a structure of one of the data drive ICs in which channels are divided into valid channels and dummy channels in the arrangement of FIG. 13 according to an example embodiment of the present invention. Other embodiments and configurations are also within the scope of the present invention.

In FIG. 14, in data drive ICs in which channels are divided into valid channels and dummy channels, such as the data drive IC A and the data drive IC W for supplying the data signals to the address electrodes corresponding to the region 1301, and the data drive IC A and the data drive IC W for supplying the data signals to the address electrodes corresponding to the region 1302 in FIG. 13, the first to 32nd of a total of 256 channels from the first to 256th channels are set as dummy channels, and the 225th to 256th channels are also set as dummy channels. That is, a total of 64 channels (i.e., 32 channels at the right and 32 channels at the left) are set as dummy channels. Accordingly, the 33rd to 224th channels in a central portion of the data drive IC are set as use channels.

FIGS. 13 and 14 relate to an example where the number of data drive ICs in which channels are divided into valid channels and dummy channels is 4 has been described. However, the number of data drive ICs can be set to 5 or more. This case is described below with reference to FIG. 15.

Figure 15:
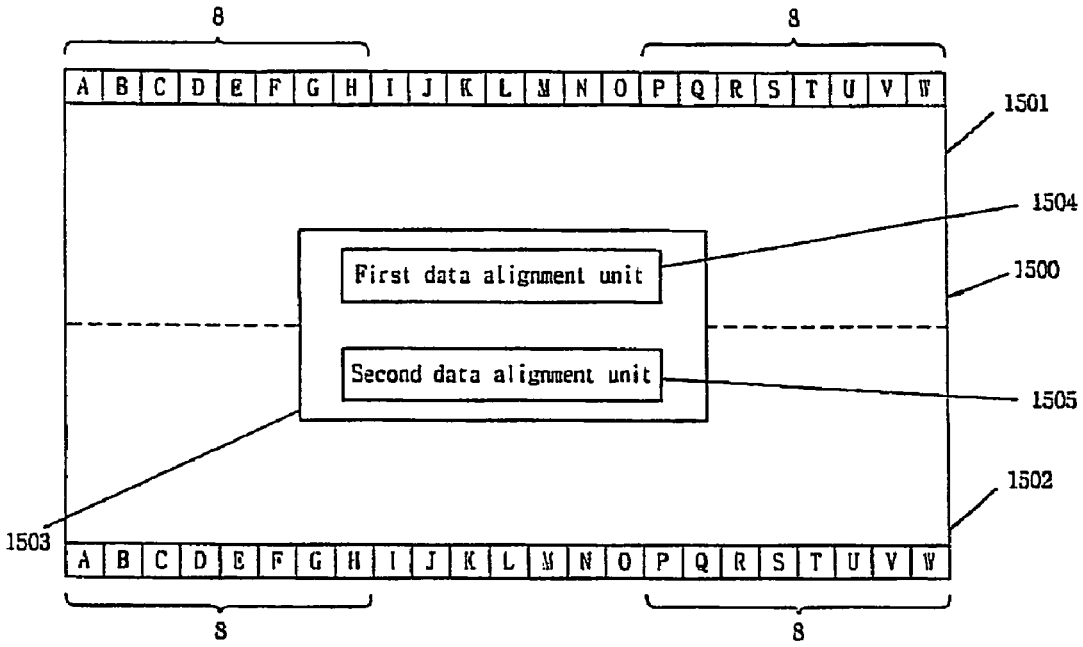
FIG. 15 is a diagram illustrating a method of electrically connecting a plasma display panel having 5760 address electrode lines and data drive ICs each having 256 channels according to an example embodiment of the present invention.

FIG. 15 is a diagram illustrating a method of electrically connecting a plasma display panel having 5760 address electrode lines and data drive ICs each having 256 channels according to an example embodiment of the present invention. Other embodiments and configurations are also within the scope of the present invention.

In FIG. 15, unlike the example of FIG. 13, the first (i.e., a data drive IC A) of data drive ICs, which supply data signals to address electrodes corresponding to the region 1501, from one side of the region 1501 of a plasma display panel 1500 and the first (i.e., a data drive IC W) of the data drive ICs, which supply data signals to address electrodes corresponding to the region 1501, from the other side in the region 1501 of the plasma display panel 1500 have a same arrangement of dummy channels. Further, the second (i.e., a data drive IC B) of the data drive ICs, which supply the data signals to the address electrodes corresponding to the region 1501, from one side of the region 1501 and the second (i.e., a data drive IC V) of the data drive ICs, which supply data signals to address electrodes corresponding to the region 1501, from the other side of the region 1501, have the same arrangement of dummy channels. In this manner, data drive ICs C and U, D and T, E and S, F and R, G and Q, and H and P have the same arrangements of dummy channels, respectively. Furthermore, every eight channels are set as dummy channels. Accordingly, the number of use channels of all the channels of the data drive ICs for supplying the data signals to the address electrodes corresponding to the region 1501 is (256×23)−(8×16) =5760. As described above, data drive ICs in which channels are divided into valid channels and dummy channels are plural in number, and the number of use channels within the plurality of data drive ICs may be the same. This method allows for more stabilized driving as compared to the example embodiment of FIG. 13 since a load value added to one data drive IC is distributed into a total of eight data drive ICs.

The example of FIG. 15 is substantially the same as the embodiment of FIG. 13 except for a number of data drive ICs having valid channels and dummy channels and a number of valid channels and dummy channels in these data drive ICs. Therefore, a further description will be omitted for the ease of description.

In such a case, the detailed structure of the data drive ICs A, B, C, D, E, F, G and H and the data drive ICs P, Q, R, S, T, U, V and W for supplying data signals to address electrodes corresponding to the region 1501, and the data drive ICs A, B, C, D, E, F, G and H and the data drive ICs P, Q, R, S, T, U, V and W for supplying data signals to address electrodes corresponding to the region 1502 will be described below with reference to FIG. 16.

Figure 16:
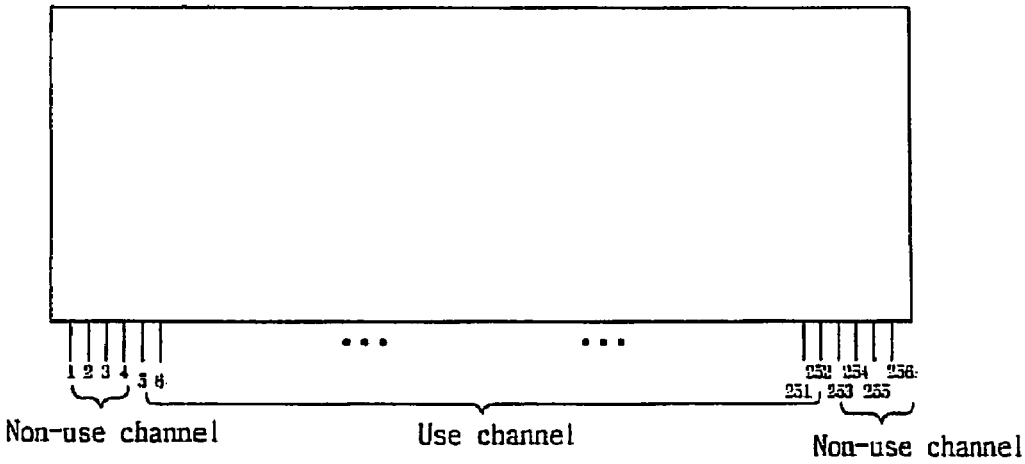
FIG. 16 is a diagram illustrating structure of a data drive IC in which channels are divided into valid channels and dummy channels in the arrangement of FIG. 15 according to an example embodiment of the present invention.

FIG. 16 is a diagram illustrating a structure of a data drive IC in which channels are divided into valid channels and dummy channels in the arrangement of FIG. 15 according to an example embodiment of the present invention. Other embodiments and configurations are also within the scope of the present invention.

Referring to FIG. 16, in the data drive ICs, in which channels are divided into valid channels and dummy channels, such as the data drive ICs A, B, C, D, E, F, G and H and the data drive ICs P, Q, R, S, T, U, V and W for supplying data signals to address electrodes corresponding to the region 1501, and the data drive ICs A, B, C, D, E, F, G and H and the data drive ICs P, Q, R, S, T, U, V and W for supplying data signals to address electrodes corresponding to the region 1502, the first to fourth of a total of 256 channels ranging from the first channel to a 256th channel are set as dummy channels, and the 253rd to 256th channels are set as dummy-channels. That is, a total of eight channels (four at the right and four at the left) are set as dummy channels. Accordingly, the fifth to 252nd channels in a central portion of the data drive IC are set as valid channels.

FIGS. 13 to 16 show examples where there exist data drive ICs in which channels are not divided into valid channels and dummy channels. Unlike this, channels can be divided into valid channels and dummy channels in all of the plurality of data drive ICs as will be described below with reference to FIG. 17.

Figure 17:
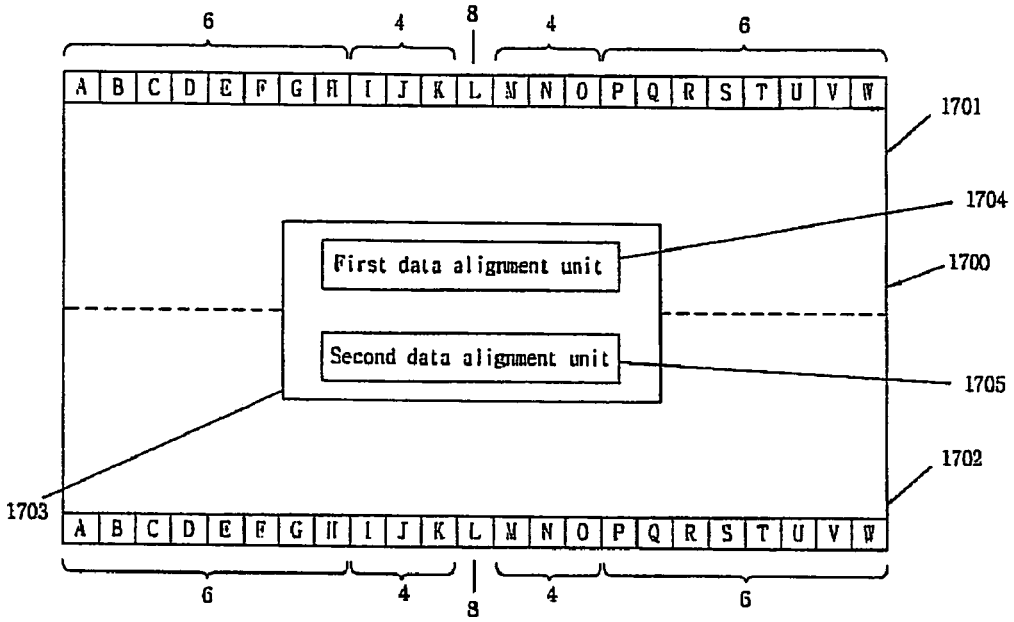
FIG. 17 is a diagram illustrating electrically connecting a plasma display panel having 5760 address electrode lines and data drive ICs each having 256 channels according to an example embodiment of the present invention.

FIG. 17 is a diagram illustrating electrically connecting a plasma display panel having 5760 address electrode lines and data drive ICs each having 256 channels according to an example embodiment of the present invention. Other embodiments and configurations are also within the scope of the present invention.

In FIG. 17, channels are divided into valid channels and dummy channels in all data drive ICs unlike the examples of FIGS. 13 and 15. For example, the first (i.e., an data drive IC A) of data drive ICs, which supply data signals to address electrodes corresponding to the region 1701, from one side end of a region 1701 of a plasma display panel 1700 and a first data drive IC (i.e., a data drive IC W) from the other side end of the region 1701 of the plasma display panel 1700, have the same arrangement of dummy channels. The second (i.e., a data drive IC B) of the data drive ICs, which supply the data signals to the address electrodes corresponding to the region 1701, from one side end of the region 1701 and a second data drive IC (i.e., a data drive IC V) from the other side end of the region 1701, have the same arrangement of dummy channels. In this manner, data drive ICs C and U, D and T, E and S, F and R, G and Q, and H and P have the same structure, respectively, and six channels are set as dummy channels in each of the data drive ICs C and U, D and T, E and S, F and R, G and Q, and H and P. Furthermore, data drive ICs I and O, J and N, and K and M have the same arrangement of the dummy channels, respectively, and four channels are set as dummy channels in each of the data drive ICs I and O, J and N, and K and M. Furthermore, eight channels are set as dummy channels in the data drive IC L.

Accordingly, the number of valid channels of all the channels of the data drive ICs for supplying the data signals to the address electrodes corresponding to the region 1701 is $(256\times 23)-\{(6\times 16)+(4\times 6)+(8\times 1)\}=5760$. As described above, in all the data drive ICs, channels may be divided into valid channels and dummy channels. This may allow for more stabilized driving as compared to the example of FIG. 15, since a load value added to one data drive IC may be uniformly distributed among 23 data drive ICs.

Figure 18A:
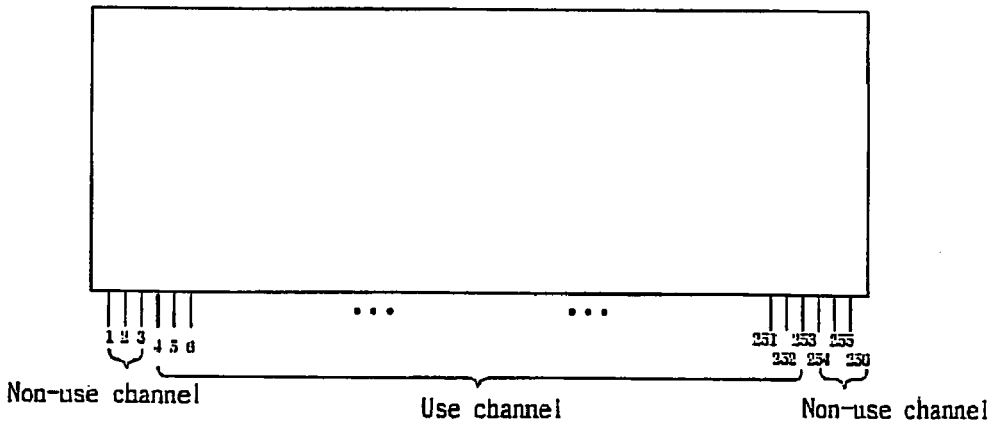
FIGS. 18*a* to 18*c* are diagrams illustrating structure of the data drive IC A in which channels are divided into valid channels and dummy channels in the arrangement of FIG. 17 according to an example embodiment of the present invention.
Figure 18B:
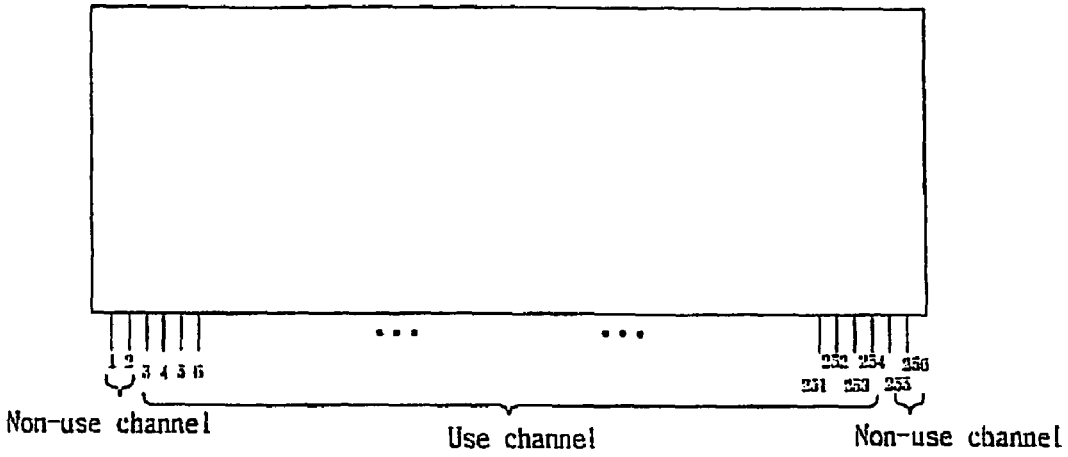
Figure 18C:
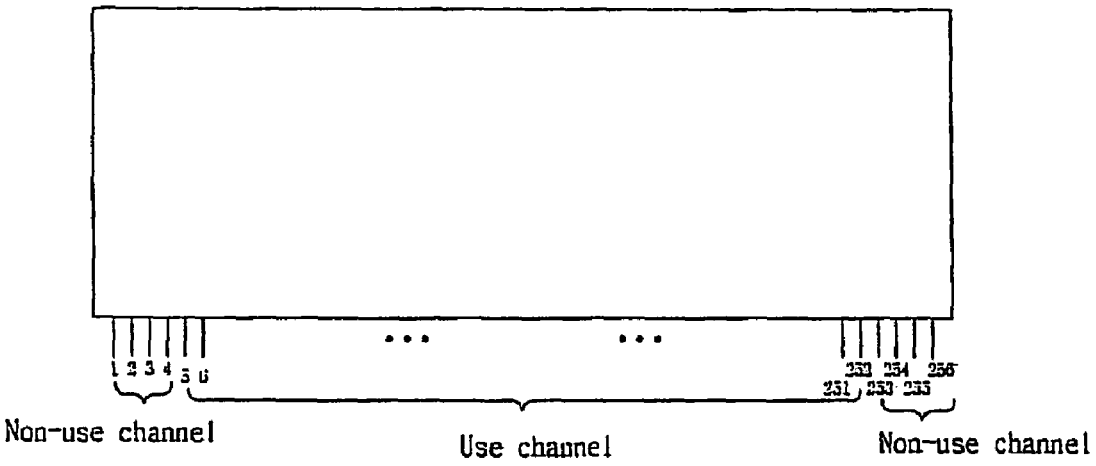

The structures of the data drive ICs are described below in detail with reference to FIGS. 18*a* to 18*c*. More specifically, FIGS. 18*a* to 18*c* are diagrams illustrating structures of the data drive ICs in which channels are divided into valid channels and dummy channels in the arrangement of FIG. 17 according to an example embodiment of the present invention. Other embodiments and configurations are also within the scope of the present invention.

Referring to FIG. 18*a*, in the data drive ICs in which six channels are classified as dummy channels, such as the data drive ICs A, B, C, D, E, F, G and H and the data drive ICs P, Q, R, S, T, U, V and W for supplying data signals to address electrodes corresponding to the region 1701, and the data drive ICs A, B, C, D, E, F, G and H and the data drive ICs P, Q, R, S, T, U, V and W for supplying data signals to address electrodes corresponding to the region 1702, the first to third of 256 channels ranging from the first channel to the 256th channel are set as dummy channels, and the 254th to 256th channels are set as dummy channels. That is, six channels (three at the right and three at the left) are set as dummy channels. Accordingly, the fourth to 253rd channels in the central portion of the data drive IC are set as valid channels.

Referring to FIG. 18*b*, in data drive ICs in which four channels are classified as dummy channels, such as the data drive ICs I, J and K and the data drive ICs M, N and O for supplying data signals to address electrodes corresponding to the region 1701, and the data drive ICs I, J and K and the data drive ICs M, N and O for supplying data signals to address electrodes corresponding to the region 1702, the first and second of 256 channels ranging from the first channel to a 256th channel are set as dummy channels, and the 255th and 256th channels are set as dummy channels. That is, four channels (two at the left and two at the right) are set as dummy channels. Accordingly, the third to 254th channels in the central portion of the data drive IC are set as valid channels.

Referring to FIG. 18*c*, in data drive ICs in which eight channels are classified as dummy channels, such as the data drive IC L for supplying data signals to address electrodes corresponding to the region 1701, and the data drive IC L for supplying data signals to the region 1702, the first to fourth of 256 channels ranging from the first channel to the 256th channel are set as dummy channels, and the $253^{rd}$ to 256th channels are also set as dummy channels. That is, eight channels (four at the left and four at the right) are set as dummy channels. Accordingly, the fifth to 252nd channels in the central portion of the data drive IC are set as valid channels.

A plasma display apparatus has been described in detail according to an example embodiment of the present invention in which a dual scan method is applied and in which a plasma display panel serving as the display surface is scanned in a state of being divided into two regions. This method may be more effective when the size of the plasma display panel is relatively large.

While embodiments of the present invention have been described with respect to a plasma display panel, the present invention may also be applied to flat panel displays such as Liquid Crystal Displays (LCD), Organic Light Emitting Diodes (OLED) and Field Emission Displays (FED).

For example, in a LCD, a plurality of pixels for displaying an image may be formed in the LCD similar to in the plasma display panel. The LCD includes electrodes for supplying image data to these pixels and drive units. Further, as the size increases, the LCD may be disadvantageous in scanning all pixels through one scanning process in terms of noise generation in image data, scanning time, etc.

The dual scan method may therefore be applied to the LCD, where a display region is divided into two regions and the divided regions are separately scanned. As a result, dummy channels and valid channels are divided from each other in the above-described dual scan method. Therefore, embodiments are not limited to a plasma display panel, but can be applied to other flat panel displays such as LCDs.

Various features and embodiments will now be described. Each of these features and/or embodiments is merely exemplary as others are also within the scope of the present invention.

In accordance with an example embodiment of the present invention, a plasma display apparatus is provided that includes a plasma display panel including first and second address electrode groups that correspond to first and second screen regions, respectively, and that match each other. First data drive ICs including channels connected to the first address electrode group are provided. Second data drive ICs including channels connected to the second address electrode group are also provided. An nth channel of a first data drive IC from a first side of the first screen region is a dummy channel, an nth channel from a second side of the first screen region is a dummy channel, and an nth channel of a second data drive IC from a first side of the second screen region, which matches the first side of the first screen region, is also a dummy channel.

Dummy channels are channels that are not connected to the first and second address electrode groups or to which data is not supplied. Channels other than the dummy channel are valid channels to which data are supplied.

The number of first data drive ICs and the number of second data drive ICs may be identical to each other.

The number of channels of an mth first data drive IC from a first side of the first screen region may be identical to the number of channels of an mth first data drive IC from a second side of the first screen region and the number of channels of an mth second data drive IC from a first side of the second screen region, which matches the first side of the first screen region.

The first data drive ICs and the second data drive ICs may be plural in number.

The number of channels of the first data drive ICs and the number of channels of the second data drive ICs may be identical to each other.

One or more of the first data drive ICs and one or more of the second data drive ICs may each include one or more dummy channels.

The dummy channels may have an arrangement that is horizontally symmetrical within a data drive IC.

The number of dummy channels of an mth first data drive IC from a first side of the first screen region, which has one or more dummy channels, may be identical to the number of dummy channels of an mth first data drive IC from a second side of the first screen region, which has one or more dummy channels, and the number of dummy channels of an mth second data drive IC from a first side of the second screen region matching the first side of the first screen region, which has one or more dummy channels.

An arrangement of dummy channels of an mth first data drive IC from a first side of the first screen region, which has one or more dummy channels, may be identical to an arrangement of dummy channels of an mth first data drive IC from the second side of the first screen region, which has one or more dummy channels, and an arrangement of dummy channels of an mth second data drive IC from the first side of the second screen region matching the first side of the first screen region, which has one or more dummy channels.

Each of the first data drive ICs and each of the second data drive ICs may include one or more dummy channels.

All channels of at least one of the first data drive ICs and all channels of at least one of the second data drive ICs may be valid channels to which data are supplied.

One of the first data drive ICs located at a first side end in the first screen region and another first data drive IC located at a second side end of the first screen region may include all dummy channels. One of the second data drive ICs located at a first side end of the second screen region and another second data drive IC located at a second side end of the second screen region may include all dummy channels.

A total number of dummy channels of the first data drive ICs in the first screen region may be identical to a total number of dummy channels of the second data drive ICs in the second screen region.

An arrangement of the dummy channels in the first screen region may be horizontally symmetrical. An arrangement of the dummy channels in the second screen region may be horizontally symmetrical. An arrangement of the dummy channels in the first screen region and an arrangement of the dummy channels in the second screen region may be symmetrical to each other around a border between the first screen region and the second screen region.

Each of the first data drive ICs and the second data drive ICs may be four or more in number.

Embodiments of the present invention may provide a method of driving a plasma display apparatus. This may include applying data to the first data drive ICs and rearranging the data so that second region data that are applied from the second data drive ICs to the second address electrode group match first region data that are applied from the first data drive ICs to the first address electrode group. The rearranged data may be applied to the second data drive ICs.

Rearranging the data may include reversing the first region data to data corresponding to the first data drive ICs, respectively; and reversing the first region data that are reversed to the data corresponding to the first data drive ICs, for every first data drive IC.

The data applied to the first data drive ICs and the data applied to the second data drive ICs may be applied in an identical sequence from a first side of a plasma display panel.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel having first and second address electrode groups that correspond to first and second screen regions respectively, wherein the first screen region and the second screen region are scanned simultaneously;

a first plurality of data drive ICs each including channels connected to the first address electrode group, the first plurality of data drive ICs including at least a first data drive IC and a second data drive IC;

a second plurality of data drive ICs each including channels connected to the second address electrode group, the second plurality of data drive ICs including at least a third data drive IC and a fourth data drive IC;

a first data alignment unit to supply data to the first plurality of data drive ICs; and a second data alignment unit to supply data to the second plurality of data drive ICs, wherein an nth channel of the first data drive IC from a first side of the first screen region is a dummy channel, an nth channel of the second data drive IC from a second side of the first screen region is a dummy channel, an nth channel of the third data drive IC from a first side of the second screen region is a dummy channel, and an nth channel of the fourth data drive IC from a second side of the second screen region is a dummy channel, and the first side of the first screen region and the first side of the second screen region correspond to a same side of the plasma display panel.

2. The plasma display apparatus according to claim 1, wherein the dummy channels are channels not connected to the first address electrode group or to the second address electrode group, and an nth channel of the fourth data drive IC from the second side of the second screen region is a dummy channel.

3. The plasma display apparatus according to claim 1, wherein the dummy channels are channels that are not supplied with data during operation of the plasma display apparatus.

4. The plasma display apparatus according to claim 1, wherein the channels other than the dummy channels are valid channels to which data is supplied.

5. The plasma display apparatus according to claim 1, wherein a number of the first plurality of data drive ICs is equal to a number of the second plurality of data drive ICs.

6. The plasma display apparatus according to claim 1, wherein a number of channels of an mth one of the first plurality of data drive IC from the first side of the first screen region is equal to a number of channels of an mth one of the first plurality of data drive ICs from the second side of the first screen region, and is equal to a number of channels of an mth one of the second plurality of data drive ICs from the first side of the second screen region, and to a number of channels of an mth one of the second plurality of data drive ICs from the second side of the second screen region.

7. The plasma display apparatus according to claim 1, wherein a number of channels associated with the first data drive IC equals a number of channels associated with the second data drive IC.

8. The plasma display apparatus according to claim 1, wherein the dummy channels of the first plurality of data drive ICs are symmetrically positioned along one side of the plasma display panel.

9. The plasma display apparatus according to claim 8, wherein the dummy channels of the second plurality of data drive ICs are symmetrical positioned along another side of the plasma display panel.

10. The plasma display apparatus according to claim 8, wherein a number of dummy channels of an mth one of the first plurality of data drive ICs from the first side of the first screen region is equal to a number of dummy channels of an mth one of the first plurality of data drive ICs from the second side of the first screen region, and is equal to a number of dummy channels of an mth one of the second plurality of data drive ICs from the first side of the second screen region, and to a number of channels of an mth one of the second plurality of data drive ICs from the second side of the second screen region.

11. The plasma display apparatus according to claim 8, wherein an arrangement of dummy channels of an mth one of the first plurality of data drive ICs from the first side of the first screen region is identical to an arrangement of dummy channels of an mth one of the first plurality of data drive ICs from the second side of the first screen region and is identical to an arrangement of dummy channels of an mth one of the second plurality of data drive ICs from the first side of the second screen region, to an arrangement of dummy channels of an mth one of the second plurality of data drive ICs from the second side of the second screen region.

12. The plasma display apparatus according to claim 8, wherein each of the first plurality of data drive ICs and each of the second plurality of data drive ICs includes at least one dummy channel.

13. The plasma display apparatus according to claim 1, wherein all channels of at least one of the first plurality of data drive ICs and all channels of at least one of the second plurality of data drive ICs are valid channels to which data are supplied.

14. The plasma display apparatus according to claim 8, wherein:

one of the first plurality of data drive ICs located near the first side of the first screen region and another one of the first plurality of data drive ICs located near the second side of the first screen region include all the dummy channels of the first screen region; and one of the second plurality of data drive ICs located near the first side of the second screen region and another one of the second plurality of data drive ICs located near a second side of the second screen region include all the dummy channels of the second screen region.

15. The plasma display apparatus according to claim 1, wherein a total number of dummy channels of the first plurality of data drive ICs associated with the first screen region is equal to a total number of dummy channels of the second plurality of data drive ICs associated with the second screen region.

16. The plasma display apparatus according to claim 1, wherein an arrangement of the dummy channels in the first screen region is horizontally symmetrical, an arrangement of the dummy channels in the second screen region is horizontally symmetrical, and an arrangement of the dummy channels in the first screen region and an arrangement of the dummy channels in the second screen region are symmetrical with respect to each other around a border between the first screen region and the second screen region.

17. The plasma display apparatus according to claim 1, wherein the first plurality of data drive ICs include at least four data drive ICs and the second plurality of data drive ICs include at least four data drive ICs.

18. The plasma display apparatus according to claim 1, wherein the first data alignment unit is arranged to apply data to the first plurality of data drive ICs;

the second data alignment unit is arranged to rearrange data so that second region data applied from the second plurality of data drive ICs to the second address electrode group matches first region data applied from the first plurality of data drive ICs to the first address electrode group, and the second data alignment unit is arranged to apply the rearranged data to the second plurality of data drive ICs.

19. The plasma display apparatus according to claim 18, wherein the second data alignment unit is arranged to rearrange the data by:

reversing the first region data to data corresponding to the first plurality of data drive ICs; and reversing the first region data that have been reversed to the data corresponding to the first plurality of data drive ICs.

20. The plasma display apparatus according to claim 18, wherein the data applied to the first plurality of data drive ICs are arranged to be applied in an identical sequence to the data applied to the second plurality of data drive ICs.

21. A display apparatus comprising:

a display panel having a first side, a second side, a third side and a fourth side, the display panel including a first address electrode group corresponding to a first screen region and a second address electrode group corresponding to a second screen region, wherein the first screen region and the second screen region are scanned simultaneously;

a first plurality of data drivers provided near the first side of the panel and each including channels associated with the first electrode group;

a second plurality of data drivers provided near the third side of the panel and each including channels associated with the second address electrode group;

a first data alignment unit to supply data to the first plurality of data drivers; and a second data alignment unit to supply data to the second plurality of data drivers, wherein an nth channel of the first plurality of data drivers is a dummy channel and an (N−n)th channel of the first plurality of data drivers is a dummy channel, and the dummy channels are symmetrically arranged along the first side of the panel.

22. The display apparatus of claim 21, wherein an nth channel of the second plurality of data drivers is a dummy channel, and the dummy channels of the first address electrode group are symmetrical arranged with respect to the dummy channels of the second address electrode group about a center region of the display panel.

23. The display apparatus according to claim 21, wherein the dummy channels comprises channels that are not supplied with data or are channels that are not supplied with data.

24. The display apparatus according to claim 23, wherein channels other than the dummy channels are valid channels to which data is supplied.

25. The display apparatus according to claim 20, wherein a number of channels of an mth one of the first plurality of data drivers from the fourth side of the display panel is equal to a number of channels of an mth one of the first plurality of data drivers from the second side of the display panel, and is equal to a number of channels of an mth one of the second plurality of data drivers from the fourth side of the display panel.

26. The display apparatus according to claim 20, wherein a number of dummy channels of an mth one of the first plurality of data drivers from the fourth side of the display panel is equal to a number of dummy channels of an mth one of the first plurality of data drivers from the second side of the display panel, and is equal to a number of dummy channels of an mth one of the second plurality of data drivers from the fourth side of the display panel.

27. The display apparatus according to claim 20, wherein an arrangement of dummy channels of an mth one of the first plurality of data drivers from the fourth side of the display panel is identical to an arrangement of dummy channels of an mth one of the first plurality of data drivers from the second side of the display panel, and is identical to an arrangement of dummy channels of an mth one of the second plurality of data drivers from the fourth side of the display panel.

28. The display apparatus according to claim 21, wherein a total number of dummy channels of the first plurality of data drivers in the first screen region of the display panel is equal to a total number of dummy channels of the second plurality of data drivers in the second screen region of the display panel.

29. The display apparatus according to claim 28, wherein an arrangement of the dummy channels in the first screen region is horizontally symmetrical, an arrangement of the dummy channels in the second screen region is horizontally symmetrical, and an arrangement of the dummy channels in the first screen region and an arrangement of the dummy channels in the second screen region are symmetrical with respect to each other about a border between the first screen region and the second screen region.

30. The display apparatus according to claim 21, wherein the second data alignment unit to rearrange the data so that second region data applied from the second plurality of data drivers to the second address electrode group matches first region data applied from the first plurality of data drivers to the first address electrode group, and the second data alignment group to apply the rearranged data to the second plurality of data drivers.

* * * * *